US008475878B2

(12) United States Patent
Claasen et al.

(10) Patent No.: US 8,475,878 B2
(45) Date of Patent: Jul. 2, 2013

(54) POLYOLEFIN DISPERSION TECHNOLOGY USED FOR POROUS SUBSTRATES

(75) Inventors: Gert Johannes Claasen, Richterswil (CH); Miguel Alberto Prieto, Richterswil (CH); Martin Pavlik, Wadenswil (CH)

(73) Assignee: Dow Global Technologies LLC, Midland, MI (US)

( * ) Notice: Subject to any disclaimer, the term of this patent is extended or adjusted under 35 U.S.C. 154(b) by 391 days.

(21) Appl. No.: 12/739,623

(22) PCT Filed: Oct. 14, 2008

(86) PCT No.: PCT/US2008/079815

§ 371 (c)(1),
(2), (4) Date: Apr. 23, 2010

(87) PCT Pub. No.: WO2009/055275

PCT Pub. Date: Apr. 30, 2009

(65) Prior Publication Data

US 2010/0227520 A1 Sep. 9, 2010

Related U.S. Application Data

(60) Provisional application No. 60/982,653, filed on Oct. 25, 2007.

(51) Int. Cl.
*B05D 1/00* (2006.01)

(52) U.S. Cl.
USPC ..... 427/385.5; 427/389.9; 427/394; 427/420

(58) Field of Classification Search
None
See application file for complete search history.

(56) References Cited

U.S. PATENT DOCUMENTS

| | | | |
|---|---|---|---|
| 2,060,961 | A | 11/1936 | Tillotson |
| 3,645,992 | A | 2/1972 | Elston |
| 3,756,973 | A | 9/1973 | Stahl |
| 3,758,643 | A | 9/1973 | Fischer |
| 3,806,558 | A | 4/1974 | Fischer |
| 3,849,241 | A | 11/1974 | Butin et al. |
| 4,076,698 | A | 2/1978 | Anderson et al. |
| 4,104,210 | A | 8/1978 | Coran et al. |
| 4,130,535 | A | 12/1978 | Coran et al. |
| 4,202,801 | A | 5/1980 | Petersen |
| 4,250,273 | A | 2/1981 | Bohm et al. |
| 4,271,049 | A | 6/1981 | Coran et al. |
| 4,311,628 | A | 1/1982 | Abdou-Sabet et al. |

(Continued)

FOREIGN PATENT DOCUMENTS

| | | |
|---|---|---|
| DE | 2513251 A1 | 9/1976 |
| EP | 0525671 | 2/1993 |

(Continued)

OTHER PUBLICATIONS

Chinese Office Action for counterpart Chinese Application No. 200880122859.2, dated Oct. 19, 2011, 7 pages.

(Continued)

*Primary Examiner* — Erma Cameron

(57) ABSTRACT

A method of forming an article that includes applying an aqueous dispersion to a porous substrate, wherein the aqueous dispersion includes a thermoplastic polymer, a dispersing agent, and water. The method includes removing at least a portion of the water, to result in an article formed that is breathable.

10 Claims, 1 Drawing Sheet

U.S. PATENT DOCUMENTS

| | | | | |
|---|---|---|---|---|
| 4,340,684 | A | 7/1982 | Bohm et al. | |
| 4,536,890 | A | 8/1985 | Barnett et al. | |
| 4,599,392 | A | 7/1986 | McKinney et al. | |
| 4,684,568 | A * | 8/1987 | Lou | 442/76 |
| 4,762,890 | A | 8/1988 | Strait et al. | |
| 4,795,668 | A | 1/1989 | Krueger et al. | |
| 4,918,754 | A | 4/1990 | Leatherman et al. | |
| 4,927,882 | A | 5/1990 | Bayan | |
| 4,927,888 | A | 5/1990 | Strait et al. | |
| 4,950,541 | A | 8/1990 | Tabor et al. | |
| 4,988,781 | A | 1/1991 | McKinney et al. | |
| 5,051,478 | A | 9/1991 | Puydak et al. | |
| 5,057,368 | A | 10/1991 | Largman et al. | |
| 5,069,970 | A | 12/1991 | Largman et al. | |
| 5,108,820 | A | 4/1992 | Kaneko et al. | |
| 5,108,827 | A | 4/1992 | Gessner | |
| 5,246,658 | A | 9/1993 | Tanaka | |
| 5,248,729 | A | 9/1993 | Inoue et al. | |
| 5,272,236 | A | 12/1993 | Lai et al. | |
| 5,277,976 | A | 1/1994 | Hogle et al. | |
| 5,278,272 | A | 1/1994 | Lai et al. | |
| 5,294,482 | A | 3/1994 | Gessner | |
| 5,336,552 | A | 8/1994 | Strack et al. | |
| 5,382,400 | A | 1/1995 | Pike et al. | |
| 5,384,373 | A | 1/1995 | McKinney et al. | |
| 5,466,410 | A | 11/1995 | Hills | |
| 5,504,172 | A | 4/1996 | Imuta et al. | |
| 5,581,812 | A | 12/1996 | Krocheski | |
| 5,756,659 | A | 5/1998 | Hughes et al. | |
| 5,844,045 | A | 12/1998 | Kolthammer et al. | |
| 5,869,575 | A | 2/1999 | Kolthammer et al. | |
| 5,938,437 | A | 8/1999 | DeVincenzo | |
| 5,981,019 | A | 11/1999 | Goodwin et al. | |
| 6,051,681 | A | 4/2000 | Dozeman | |
| 6,075,179 | A | 6/2000 | McCormack et al. | |
| 6,448,341 | B1 | 9/2002 | Kolthammer et al. | |
| 6,455,636 | B2 | 9/2002 | Sanada | |
| 6,538,070 | B1 | 3/2003 | Cardwell et al. | |
| 6,545,088 | B1 | 4/2003 | Kolthammer et al. | |
| 6,566,446 | B1 | 5/2003 | Parikh et al. | |
| 7,439,276 | B2 | 10/2008 | Strandburg et al. | |
| 2003/0104193 | A1 * | 6/2003 | Martin et al. | 428/304.4 |
| 2004/0139529 | A1 | 7/2004 | Herbert et al. | |
| 2005/0031872 | A1 * | 2/2005 | Schmidt et al. | 428/403 |
| 2005/0100754 | A1 | 5/2005 | Moncla et al. | |
| 2005/0192365 | A1 | 9/2005 | Strandburg et al. | |
| 2007/0141933 | A1 * | 6/2007 | Wevers et al. | 442/103 |
| 2008/0009586 | A1 | 1/2008 | VanSumeren et al. | |
| 2008/0176468 | A1 * | 7/2008 | Chen | 442/1 |
| 2008/0176968 | A1 | 7/2008 | VanSumeren et al. | |
| 2010/0143652 | A1 * | 6/2010 | Stockton et al. | 428/141 |

FOREIGN PATENT DOCUMENTS

| | | |
|---|---|---|
| GB | 1532072 | 11/1978 |
| JP | 2216273 | 8/1990 |
| WO | 96/19396 | 6/1996 |
| WO | 00/01745 | 1/2000 |
| WO | 2005/021622 | 3/2005 |
| WO | 2005/021638 | 3/2005 |
| WO | 2007/078536 | 7/2007 |

OTHER PUBLICATIONS

EP Response to Rule 161 and Rule 162/ Claim Amendments in EP Counterpart Application No. 08842885.9-2307, dated Jun. 6, 2011, 7 pages.

International Search Report dated Apr. 1, 2010 from counterpart PCT Application No. PCT/US2008/079815, 2 pages.

Written Opinion dated Mar. 1, 2011 from counterpart PCT Application No. PCT/US2008/079815, 4 pages.

Response to Chinese Office Action filed Mar. 5, 2012 for counterpart Chinese Application No. 200880122859.2.

Chinese 2nd Office Action dated Aug. 3, 2012; from CN counterpart application No. 200880122859.2.

Instructions to Chinese 2nd Office Action dated Oct. 3, 2012; from CN counterpart application No. 200880122859.2.

Chinese Response to 2nd Office Action dated Oct. 11, 2012; from CN counterpart application No. 200880122859.2.

* cited by examiner

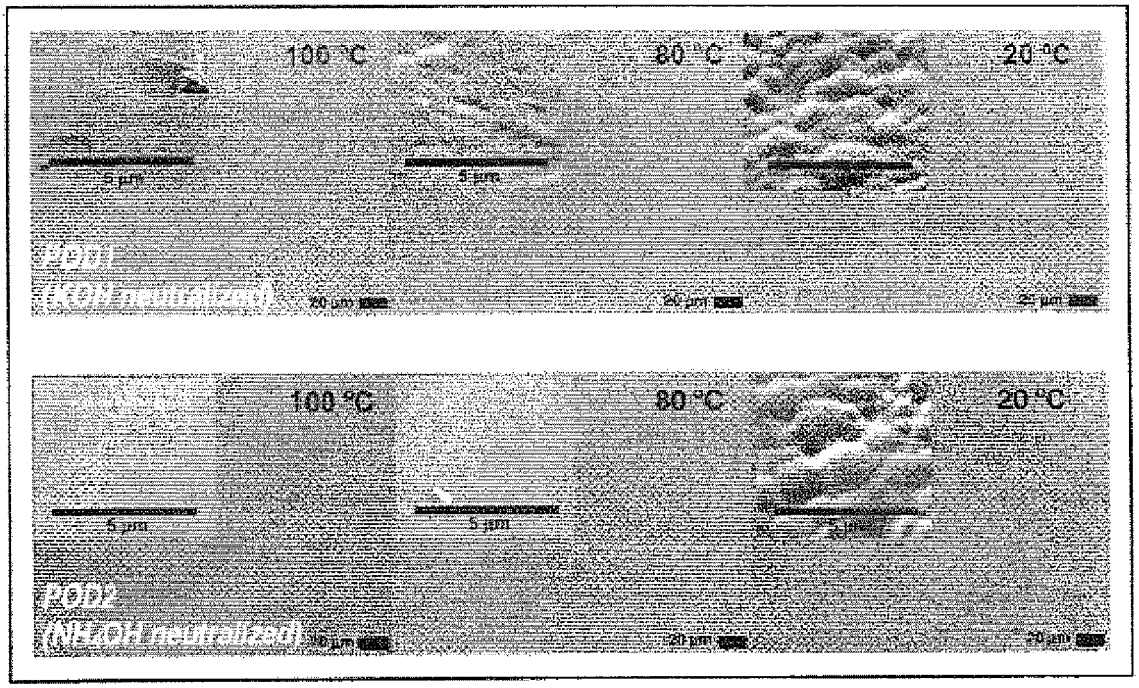
100 °C
80 °C
20 °C
5 µm
5 µm
(KOH neutralized)
20 µm
20 µm
20 µm
100 °C
80 °C
20 °C
5 µm
5 µm
(NH4OH neutralized)
20 µm
20 µm
20 µm

POLYOLEFIN DISPERSION TECHNOLOGY USED FOR POROUS SUBSTRATES

BACKGROUND OF INVENTION

1. Field of the Invention

Embodiments disclosed herein relate generally to methods for forming breathable articles, and breathable articles formed using those methods.

2. Background

Coverings, such as gloves, mitts, socks, shoes, or boots, long have been used to protect hands and feet from environmental or work conditions. Depending on the type of environment, nature of work, or desired properties, these type of coverings have been made from a variety of materials, which have included woven cloth fabrics, leather, natural latex or synthetic polymer elastomeric materials, or combinations of such materials. These articles typically have been designed for durable use.

The vast majority of gloves or foot covers, typically, have been made from either woven cloth fabrics, suede, or leather. Gloves made of woven fabrics generally allow the skin of the wearer to breathe through the spaces between the individual strands of woven fabric material, and any perspiration from the hand or foot is wicked away by the fabric. Leather tends not to fit as comfortably as cloth or fabric-lined articles, nor is it as flexible, or permits the skin to breathe as easily. Moreover, leather, while resilient, typically is not as good of a barrier against prolonged exposure to wetness or hazards as polymeric elastomer materials.

For applications that require greater protection against fluids, chemicals, or microscopic pathogens, such as found in laboratory, healthcare and clinical, or other work settings, the protective articles—gloves in particular—traditionally have incorporated a barrier layer that is impervious to the undesirable substances. Surgical, examination, or work gloves, for example, typically are made using natural or synthetic rubber latex or other elastic polymer membranes, which generally exhibit good barrier properties. Unfortunately, the good barrier properties of such materials may create a harsh environment for the wearer's skin, which is bad for skin/hand health.

For example, wearing a glove made from an elastic polymer latex for prolonged periods can trap perspiration in the article because the wearer's skin is not able to adequately breathe, making the glove uncomfortable to wear. As perspiration accumulates, the moist environment within the article may become a potential source or incubator for the growth of fungi or yeast, as well as bacterial or viral contamination, which can exacerbate skin problems.

People have tried to solve these problems in a variety of ways, for instance, by combining woven and elastomeric materials. A common practice has been to unite a woven or cloth-like material as an underlayer with an elastomeric membrane or film as a barrier overcoat, for a strong and resistant article (e.g., as described in U.S. Pat. No. 2,060,961, or 5,246,658, or U.S. Patent Publication No. 2004/0139529). Manufacturers have used knit, woven, or non-woven fabrics as liners in a variety of durable industrial gloves that can have a relatively long work life. Such gloves can be made in a variety of ways. For instance, as described in the patent examples, gloves are fabricated by providing a hand-shaped block mould or former, applying or fitting a woven or knit glove-shaped liner, then dipping into a polymer solution, such as latex or nitrile, to cover the glove liner.

Typically, the liners for such gloves are generally thick, hence gloves made from this type of processes usually have poor flexibility and fit loosely to the hand. In some other cases, fabrics are first laminated to a polymer layer and then sealed under harsh conditions to form an air and water-proof seam, such as described in U.S. Pat. No. 5,981,019, which discloses an air and liquid-proof protective cover for use in harsh environments. Furthermore, the configuration of the human hand is such that the thumb projects considerably beyond the palm, and the thumb and other four fingers can move relatively freely in relation to each other to perform any desired task.

Gloves that are made according to conventional methods are often made on a flat hand-shaped dipping mould or a last. Since a hand or foot has three-dimensionality, gloves or foot covers that are made in largely flat moulds do not fit the hand or foot well when worn and feel uncomfortable, which can be cumbersome when working.

According to other approaches, manufacturers fabricate elastomeric articles reinforced with fibers. Common work gloves, such as for housework or industrial uses, are examples of this latter design. Manufacturers of fiber-reinforced gloves incorporate an internal lining composed of fibrous material, such as cotton flock (e.g., U.S. Pat. Nos. 4,918,754, 4,536,890, or 5,581,812). Typically, flock is composed of finely divided, short, ground, fibrous particles, which can be applied as a lining by spraying the flock particles onto an adhesive-covered backing (e.g., the external shell of a glove). An inner glove lining of flock provides a smooth, comfortable feeling, cushions the hands, absorbs perspiration and keeps the hands dry, insulates against moderate heat and cold without being bulky, makes the glove easier to put on and take off, and has other advantageous characteristics. Gloves with such characteristics are favored by workers and have become common articles for various heavy-duty industrial applications.

The disadvantages, however, of a glove having an internal lining composed of cotton flock or other similar fibrous material are many. First, for instance, fibers and particles can become detached from the internal lining over time through abrasion with either the glove wearer's hand or the surface of the sleeve of a garment worn by the wearer. The detached particles can migrate out of the glove, particularly when the glove is being donned or removed from the wearer's hand.

Second, fibers, like short cotton fibers, typically are not elastomeric, which makes them difficult to coat onto glove skins made of latex or nitrile materials, etc. The current commercial flocking process uses glue to make the short cotton fibers stick. Flocking is essentially a batch process, and fibers can not be embedded into the polymer layers effectively.

Like in elastomeric articles, current-commercial flocked gloves, in some cases, use powder, such as cornstarch or calcium carbonate powders, to enhance the donning and comfort. The presence of powders may help absorb some of the perspiration moisture and alleviate some of the problems the wearer faces. The use of powder, however, was only partially successful, as the powder particles could absorb only a limited amount of the moisture. Additionally, powders are not well accepted among consumers because of allergy and health concerns of small particles, or for certain uses, such as in clean-room type applications and during surgical procedures, powders may not be used at all.

Aside from industrial-type gloves with cotton liners or fabric liners, currently very few examples of disposable gloves exist that incorporate coated fibers, which can provide qualities such as comfort, good fit with flexibility, easy donning or insertion of the hand, being powder-free, allergy prevention, skin protection, and moisture absorption. For disposable latex gloves, the challenge is to create an elastomeric fiber-layer without limiting the fiber length and size to make economically viable flexible, fiber-lined, disposable gloves.

Unfortunately, current technologies for durable industrial gloves cannot satisfy this challenge.

BRIEF DESCRIPTION OF DRAWINGS

FIG. 1 shows SEM images in accordance with one disclosed embodiment.

SUMMARY OF INVENTION

In one aspect, the present invention relates to a method of forming an article comprising applying an aqueous dispersion to a porous substrate, wherein the aqueous dispersion comprises a thermoplastic polymer, a dispersing agent, and water; and removing at least a portion of the water; wherein the article formed is breathable.

Other aspects and advantages of the invention will be apparent from the following description and the appended claims.

DETAILED DESCRIPTION

The present inventors have advantageously discovered that by coating porous (e.g., nonwoven substrates) with aqueous polyolefin dispersions, breathable structures can be achieved. These structures have a unique morphology with a controllable porosity and mechanical properties that can be controlled by judicious manipulation of the following parameters:

Composition of the dispersion
Viscosity
Neutralization type
Drying temperature
Drying time
Multi layer structures
Crosslinking Briefly, then, embodiments disclosed herein provide for the fabrication of breathable coated articles that are moisture resistant. By starting with an aqueous dispersion, as opposed to traditional manufacturing techniques, the present inventors are able to employ a larger range of coating techniques such as curtain coating, spraying, casting, dipping, rotational coating, and other standard coating techniques available for dispersions, which are not available to the current breathable backsheet producers.

Before describing the present invention in detail, the terminology used herein is for the purpose of describing particular embodiments only, and is not intended to be limiting. The invention should not necessarily be limited to specific compositions, materials, designs or equipment, as such may vary. All technical and scientific terms used herein have the usual meaning conventionally understood by persons skilled in the art to which this invention pertains, unless context defines otherwise. As used in this specification and the appended claims, the singular forms "a," "an," and "the" include plural referents unless the context clearly dictates otherwise.

The term "biconstituent fibers" (sometimes also referred to as "multiconstituent fibers") as used herein refers to filaments or fibers that have been formed from at least two polymers, or the same polymer with different properties or additives, extruded from the same extruder as a blend. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Fibers of this general type are discussed in, for example, U.S. Pat. Nos. 5,108,827 and 5,294,482, to Gessner. Biconstituent fibers are also discussed in the textbook POLYMER BLENDS AND COMPOSITES by John A. Manson and Leslie H. Sperling, Plenum Press, a division of Plenum Publishing Corporation of New York, IBSN 0-306-30831-2, pp. 273-277, © 1976.

The term "breathable" as used herein refers to materials that are pervious to water vapor and gases. In other words, "breathable barriers" and "breathable films" allow water vapor to pass through, but still protect the users skin from microbes or other infectious agents. For example, "breathable" can refer to a film or laminate having a moisture vapor transmission rate (MVTR) of at least about 300 g/m$^2$ per 24 hours measured using ASTM Standard E96-80, upright cup method.

The term "conjugate fibers" as used herein refers to fibers that have been formed from at least two polymers extruded from separated extruders but spun together to form one fiber. Conjugate fibers are also sometimes referred to as multicomponent or bicomponent fibers. The polymers are usually different from each other though conjugate fibers may be monocomponent fibers. The polymers are arranged in substantially instantly positioned distinct zones across the cross-section of the conjugate fibers and extend continuously along the length of the conjugate fibers. The configuration of such a conjugate fiber may be, for example, a sheath/core arrangement, wherein one polymer is surrounded by another or may be a side by side arrangement, a pie arrangement or an "islands-in-the-sea" arrangement, Conjugate fibers are taught by U.S. Pat. No. 5,108,820 to Kaneko et al., U.S. Pat. No. 4,795,668 to Krueger et al., and U.S. Pat. No. 5,336,552 to Strack et al. Conjugate fibers are also taught in U.S. Pat. No. 5,382,400 to Pike et al. and may be used to produce crimp in the fibers by using the differential rates of expansion and contraction of the two (or more) polymers. Crimped fibers may also be produced by mechanical means and by the process of German Patent DE 25 13 251 A1. For two component fibers, the polymers may be present in ratios of 75/25, 50/50, 25/75, or any other desired ratios. The fibers may also have shapes, such as those described in U.S. Pat. No. 5,277,976 to Hogle et al., U.S. Pat. No. 5,466,410 to Hill, and U.S. Pat. Nos. 5,069,970 and 5,057,368 to Largman et al., which describe fibers with unconventional shapes.

The term "continuous" or "substantially continuous" with respect to a filament or fiber refers a filament or fiber having a length much greater than its diameter, for example having a diameter to length ratio of about 1 to 2,000 or 3,000, or greater, desirably in excess of about 1 to 5,000, 15,000 or 25,000.

The term "disposable article" refers to a single or limited use article that is made from relatively inexpensive materials that make the article cost effective to fabricate. The technical, material, and economical problems associated with disposable articles are different from articles that can be used multiple times or reused, and as such have been constructed from relatively expensive materials.

The term "machine direction" or MD means the length of a web in the direction in which it is produced. The term "cross machine direction" or CD means the width of fabric, i.e. a direction generally perpendicular to the MD.

The terms "elastic" and "elastomeric" as used herein are interchangeable and generally refer to materials that, upon application of a deforming stress or force, are stretchable in at least one direction (e.g., CD direction), and which upon release of the force returns to approximately its original size and shape. For example, a stretched material having a stretched length which is at least 5-20% greater than its relaxed unstretched length, and which will recover to within at least 5-20% of its original length upon release of the stretching, biasing force.

The term "filament" as used herein refers to a generally continuous strand that has a large ratio of length to diameter, such as, for example, a ratio of about 1 to 500-1000 or more.

The term "laminate" or "lamination" as used herein refers to a composite structure of two or more sheet material layers that have been adhered through a bonding step, such as through adhesive bonding, thermal bonding, point bonding, pressure bonding, extrusion coating, or ultrasonic bonding.

The term "meltblown fibers" refers to fibers formed by extruding a molten thermoplastic material through a plurality of fine, usually circular, die capillaries as molten threads or filaments into converging high velocity, usually hot, gas (e.g. air) streams which attenuate the filaments of thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin et al. Meltblown fibers are microfibers which may be continuous or discontinuous, are generally smaller than about 8-10 microns (μm) in average diameter, and are generally tacky when deposited on a collecting surface.

As used herein, the term "microporous film" or "microporous filled film" means films which contain filler material which enables development or formation of micropores in the film during stretching or orientation of the film.

The term "monolithic" is used to mean "non-porous," therefore a monolithic film is a non-porous film. Rather than holes produced by a physical processing of the monolithic film, the film has passages with cross-sectional sizes on a molecular scale formed by a polymerization process. The passages serve as conduits by which water molecules (or other liquid molecules) can disseminate through the film. Vapor transmission occurs through a monolithic film as a result of a concentration gradient across the monolithic film. This process is referred to as activated diffusion. As water (or other liquid) evaporates on the body side of the film, the concentration of water vapor increases. The water vapor condenses and solubilizes on the surface of the body side of the film. As a liquid, the water molecules dissolve into the film. The water molecules then diffuse through the monolithic film and re-evaporate into the air on the side having a lower water vapor concentration.

A "moisture barrier" refers to any material that is relatively impermeable to the transmission of liquid fluids, i.e. a fabric having a moisture barrier can have a blood strikethrough ratio of about 1.0 or less according to ASTM test method 22.

The term "nonwoven web" or "nonwoven fabric" refers to a web having a structure of individual fibers or threads which are interlaid, but not in an identifiable manner as in a knitted fabric. Nonwoven webs or fabrics have been formed from many processes, such as, for example, meltblowing processes, spunbonding processes, and bonded carded web processes. The basis weight of nonwoven fabrics is usually expressed in ounces of material per square yard (osy) or grams per square meter (gsm) and the fiber diameters are usually expressed in microns. (Note that to convert from osy to gsm, multiply osy by 33.91). Nonwoven webs or fabrics may be used interchangeably and are distinguishable from flocking or other collection of individual fibers that do not form a unitary structure.

In one aspect, breathable articles disclosed herein can be formed from a variety of materials. Exemplary breathable articles include diaper backsheets, protective clothing (such as gloves, mitts, socks, shoes, or boots), and packing materials.

As an exemplary embodiment, a glove can be formed as a unitary structure from a base web. Alternatively, a glove can be formed from two sections made from the same or different base webs. A base web, as used herein, refers to a substrate that includes one or more layers of fibrous materials. For most applications, gloves made according to embodiments disclosed herein are constructed for nonwoven webs containing an elastic component referred to herein as an "elastic nonwoven." An elastic nonwoven is a nonwoven material having non-elastic and elastic components or having purely elastic components. The elastic component can form a separate section of the glove. For example, the glove can be made from two or more sections of material that includes a first section made from a non-elastic material and a second section made from an elastic material. Alternatively, the glove can be made from a single piece of material that contains an elastic component. For example, the elastic component can be a film, strands, non-woven webs, or elastic filament incorporated into a laminate structure.

Non-elastic materials used in the present invention typically include nonwoven webs or films. The nonwoven webs, for instance, can be meltblown webs, spunbond webs, carded webs, and the like. The webs can be made from various fibers, such as synthetic or natural fibers. For instance, in one embodiment, synthetic fibers, such as fibers made from thermoplastic polymers, can be used to construct the glove of the present invention. For example, suitable fibers could include melt-spun filaments, staple fibers, melt-spun multicomponent filaments, and the like.

Synthetic fibers or filaments used in making the nonwoven materials of the base web have any suitable morphology, which may include hollow or solid, straight or crimped, single component, conjugate or biconstituent fibers or filaments, and blends or mixtures of such fibers and/or filaments, as are well known in the art.

The synthetic fibers used in disclosed embodiments may be formed from a variety of thermoplastic polymers where the term "thermoplastic polymer" refers to a long chain polymer that repeatedly softens when exposed to heat and substantially returns to its original state when cooled to ambient temperature. As used herein, the term "polymer" generally includes, but is not limited to, homopolymers, copolymers, such as for example, block, graft, random, and alternating copolymers, terpolymers, etc., and blends and modifications thereof. As used herein, the term "blend" means a mixture of two or more polymers. Furthermore, unless otherwise specifically limited, the term "polymer" shall include all possible geometrical configurations of the molecule. These configurations include, but are not limited to, isotatic, synditatic, and random symmetries.

Exemplary thermoplastics include, without limitation, poly(vinyl) chlorides, polyesters, polyamides, polyfluorocarbons, polyolefins, polyurethanes, polystyrenes, poly(vinyl) alcohols, caprolactams, and copolymers of the foregoing, and elastomeric polymers such as elastic polyolefins, copolyether esters, polyamide polyether block copolymers, ethylene vinyl acetates (EVA), block copolymers having the general formula A-B-A' or A-B like copoly(styrene/ethylene-butylene), styrene-poly(ethylene-propylene)-styrene, styrene-poly(ethylene-butylene)-styrene, polystyrene/poly(ethylene-butylene)/polystyrene, poly(styrene/ethylene-butylene/styrene), A-B-A-B tetrablock copolymers and the like.

Dispersions

Dispersions used in accordance with embodiments disclosed herein include a base polymer, a stabilizing agent, water, and, optionally, a filler.

Base Polymer

The base polymer resin(s) contained within the dispersion composition may vary depending upon the particular application and the desired result. In one embodiment, for instance, the base polymer may be a thermoplastic resin. In particular embodiments, the thermoplastic resin may be an olefin polymer. As used herein, an olefin polymer, in general, refers to a class of polymers formed from hydrocarbon monomers having the general formula $C_nH_{2n}$. The olefin polymer may be present as a copolymer, such as an interpolymer, a block copolymer, or a multi-block interpolymer or copolymer.

In one particular embodiment, for instance, the olefin polymer may comprise an alpha-olefin interpolymer of ethylene with at least one comonomer selected from the group consisting of a $C_3$-$C_{20}$ linear, branched or cyclic diene, or a vinyl compound, such as vinyl acetate, and a compound represented by the formula $H_2C{=}CHR$ wherein R is a $C_1$-$C_{20}$ linear, branched or cyclic alkyl group or a $C_6$-$C_{20}$ aryl group. Examples of comonomers include propylene, 1-butene, 3-methyl-1-butene, 4-methyl-1-pentene, 3-methyl-1-pentene, 1-heptene, 1-hexene, 1-octene, 1-decene, and 1-dodecene.

In other embodiments, the thermoplastic resin may be an alpha-olefin interpolymer of propylene with at least one comonomer selected from the group consisting of ethylene, a $C_4$-$C_{20}$ linear, branched or cyclic diene, and a compound represented by the formula $H_2C{=}CHR$ wherein R is a $C_2$-$C_{20}$ linear, branched or cyclic alkyl group or a $C_6$-$C_{20}$ aryl group. Examples of comonomers include ethylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the comonomer is present at about 5% by weight to about 25% by weight of the interpolymer. In one embodiment, a propylene-ethylene interpolymer is used.

Other examples of thermoplastic resins which may be used in the present disclosure include homopolymers and copolymers (including elastomers) of an olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymers, ethylene-1-butene copolymers, and propylene-1-butene copolymers; copolymers (including elastomers) of an alpha-olefin with a conjugated or non-conjugated diene as typically represented by ethylene-butadiene copolymers and ethylene-ethylidene norbornene copolymers; and polyolefins (including elastomers) such as copolymers of two or more alpha-olefins with a conjugated or non-conjugated diene as typically represented by ethylene-propylene-butadiene copolymers, ethylene-propylene-dicyclopentadi ene copolymers, ethylene-propylene-1,5-hexadiene copolymers, and ethylene-propylene-ethylidene norbornene copolymers; ethylene-vinyl compound copolymers such as ethylene-vinyl acetate copolymers with N-methylol functional comonomers, ethylene-vinyl alcohol copolymers with N-methylol functional comonomers, ethylene-vinyl chloride copolymers, ethylene acrylic acid or ethylene-(meth)acrylic acid copolymers, and ethylene-(meth) acrylate copolymers; styrenic copolymers (including elastomers) such as polystyrene, ABS, acrylonitrile-styrene copolymers, methylstyrene-styrene copolymers; and styrene block copolymers (including elastomers) such as styrene-butadiene copolymer and hydrates thereof, and styrene-isoprene-styrene triblock copolymers; polyvinyl compounds such as polyvinyl chloride, polyvinylidene chloride, and vinyl chloride-vinylidene chloride copolymers, polymethyl acrylate, and polymethyl methacrylate; polyamides such as nylon 6, nylon 6,6, and nylon 12; thermoplastic polyesters such as polyethylene terephthalate and polybutylene terephthalate; polycarbonates, polyphenylene oxides, and the like. These resins may be used either alone or in combinations of two or more.

In particular embodiments, polyolefins such as polypropylene, polyethylene, and copolymers thereof and blends thereof, as well as ethylene-propylene-diene terpolymers may be used. In some embodiments, the olefinic polymers include homogeneous polymers described in U.S. Pat. No. 3,645,992 by Elston; high density polyethylene (HDPE) as described in U.S. Pat. No. 4,076,698 to Anderson; heterogeneously branched linear low density polyethylene (LLDPE); heterogeneously branched ultra low linear density (ULDPE); homogeneously branched, linear ethylene/alpha-olefin copolymers; homogeneously branched, substantially linear ethylene/alpha-olefin polymers which can be prepared, for example, by a process disclosed in U.S. Pat. Nos. 5,272,236 and 5,278,272, the disclosure of which process is incorporated herein by reference; heterogeneously branched linear ethylene/alpha olefin polymers; and high pressure, free radical polymerized ethylene polymers and copolymers such as low density polyethylene (LDPE).

In another embodiment, the thermoplastic resin may include an ethylene-carboxylic acid copolymer, such as, ethylene-vinyl acetate (EVA) copolymers, ethylene-acrylic acid (EAA) and ethylene-methacrylic acid copolymers such as, for example, those available under the tradenames PRIMACOR™ from the Dow Chemical Company, NUCREL™ from DuPont, and ESCOR™ from ExxonMobil, and described in U.S. Pat. Nos. 4,599,392, 4,988,781, and 5,384,373, each of which is incorporated herein by reference in its entirety. Exemplary polymers include polypropylene, (both impact modifying polypropylene, isotactic polypropylene, atactic polypropylene, and random ethylene/propylene copolymers), various types of polyethylene, including high pressure, free-radical LDPE, Ziegler Natta LLDPE, metallocene PE, including multiple reactor PE ("in reactor") blends of Ziegler-Natta PE and metallocene PE, such as products disclosed in U.S. Pat. Nos. 6,545,088, 6,538,070, 6,566,446, 5,844,045, 5,869,575, and 6,448,341. Homogeneous polymers such as olefin plastomers and elastomers, ethylene- and propylene-based copolymers (for example polymers available under the trade designation VERSIFY™ available from The Dow Chemical Company and VISTAMAXX™ available from ExxonMobil) may also be useful in some embodiments. Of course, blends of polymers may be used as well. In some embodiments, the blends include two different Ziegler-Natta polymers. In other embodiments, the blends may include blends of a Ziegler-Natta and a metallocene polymer. In still other embodiments, the thermoplastic resin used herein may be a blend of two different metallocene polymers.

In one particular embodiment, the thermoplastic resin may comprise an alpha-olefin interpolymer of ethylene with a comonomer comprising an alkene, such as 1-octene. The ethylene and octene copolymer may be present alone or in combination with another thermoplastic resin, such as ethylene-acrylic acid copolymer. When present together, the weight ratio between the ethylene and octene copolymer and the ethylene-acrylic acid copolymer may be from about 1:10 to about 10:1, such as from about 3:2 to about 2:3. The polymeric resin, such as the ethylene-octene copolymer, may have a crystallinity of less than about 50%, such as less than about 25%.

Embodiments disclosed herein may also include a polymeric component that may include at least one multi-block olefin interpolymer. Suitable multi-block olefin interpolymers may include those described in U.S. Provisional Patent Application No. 60/818,911, for example. The term "multi-block copolymer" refers to a polymer comprising two or more chemically distinct regions or segments (referred to as "blocks") preferably joined in a linear manner, that is, a polymer comprising chemically differentiated units which are joined end-to-end with respect to polymerized ethylenic functionality, rather than in pendent or grafted fashion. In certain embodiments, the blocks differ in the amount or type of comonomer incorporated therein, the density, the amount of crystallinity, the crystallite size attributable to a polymer of such composition, the type or degree of tacticity (isotactic or syndiotactic), regio-regularity or regio-irregularity, the amount of branching, including long chain branching or hyper-branching, the homogeneity, or any other chemical or physical property. The multi-block copolymers are characterized by unique distributions of polydispersity index (PDI or $M_w/M_n$), block length distribution, and/or block number distribution due to the unique process making of the copolymers. More specifically, when produced in a continuous process, embodiments of the polymers may possess a PDI ranging from about 1.7 to about 8; from about 1.7 to about 3.5 in other embodiments; from about 1.7 to about 2.5 in other embodiments; and from about 1.8 to about 2.5 or from about 1.8 to about 2.1 in yet other embodiments. When produced in a batch or semi-batch process, embodiments of the polymers may possess a PDI ranging from about 1.0 to about 2.9; from about 1.3 to about 2.5 in other embodiments; from about 1.4 to about 2.0 in other embodiments; and from about 1.4 to about 1.8 in yet other embodiments.

One example of the multi-block olefin interpolymer is an ethylene/α-olefin block interpolymer. Another example of the multi-block olefin interpolymer is a propylene/α-olefin block interpolymer. The following description focuses on the interpolymer as having ethylene as the majority monomer, but applies in a similar fashion to propylene-based multi-block interpolymers with regard to general polymer characteristics.

The ethylene/α-olefin multi-block interpolymers may comprise ethylene and one or more co-polymerizable α-olefin comonomers in polymerized form, characterized by multiple (i.e., two or more) blocks or segments of two or more polymerized monomer units differing in chemical or physical properties (block interpolymer), preferably a multi-block interpolymer. In some embodiments, the multi-block interpolymer may be represented by the following formula:

$$(AB)_n$$

where n is at least 1, preferably an integer greater than 1, such as 2, 3, 4, 5, 10, 15, 20, 30, 40, 50, 60, 70, 80, 90, 100, or higher; "A" represents a hard block or segment; and "B" represents a soft block or segment. Preferably, A's and B's are linked in a linear fashion, not in a branched or a star fashion. "Hard" segments refer to blocks of polymerized units in which ethylene is present in an amount greater than 95 weight percent in some embodiments, and in other embodiments greater than 98 weight percent. In other words, the comonomer content in the hard segments is less than 5 weight percent in some embodiments, and in other embodiments, less than 2 weight percent of the total weight of the hard segments. In some embodiments, the hard segments comprise all or substantially all ethylene. "Soft" segments, on the other hand, refer to blocks of polymerized units in which the comonomer content is greater than 5 weight percent of the total weight of the soft segments in some embodiments, greater than 8 weight percent, greater than 10 weight percent, or greater than 15 weight percent in various other embodiments. In some embodiments, the comonomer content in the soft segments may be greater than 20 weight percent, greater than 25 eight percent, greater than 30 weight percent, greater than 35 weight percent, greater than 40 weight percent, greater than 45 weight percent, greater than 50 weight percent, or greater than 60 weight percent in various other embodiments.

In some embodiments, A blocks and B blocks are randomly distributed along the polymer chain. In other words, the block copolymers do not have a structure like:

AAA-AA-BBB-BB

In other embodiments, the block copolymers do not have a third block. In still other embodiments, neither block A nor block B comprises two or more segments (or sub-blocks), such as a tip segment.

The multi-block interpolymers may be characterized by an average block index, ABI, ranging from greater than zero to about 1.0 and a molecular weight distribution, $M_w/M_n$, greater than about 1.3. The average block index, ABI, is the weight average of the block index ("BI") for each of the polymer fractions obtained in preparative TREF from 20° C. and 110° C., with an increment of 5° C.:

$$ABI=\Sigma(w_i BI_i)$$

where $BI_i$ is the block index for the $1^{th}$ fraction of the multi-block interpolymer obtained in preparative TREF, and $w_i$ is the weight percentage of the $i^{th}$ fraction.

Similarly, the square root of the second moment about the mean, hereinafter referred to as the second moment weight average block index, may be defined as follows:

$$2^{nd} \text{ moment weight average } BI = \sqrt{\frac{\sum (w_i(BI_i - ABI)^2)}{\frac{(N-1)\sum w_i}{N}}}$$

For each polymer fraction, BI is defined by one of the two following equations (both of which give the same BI value):

$$BI = \frac{1/T_X - 1/T_{XO}}{1/T_A - 1/T_{AB}} \text{ or } BI = -\frac{LnP_X - LnP_{XO}}{LnP_A - LnP_{AB}}$$

where $T_X$ is the analytical temperature rising elution fractionation (ATREF) elution temperature for the $i^{th}$ fraction (preferably expressed in Kelvin), $P_X$ is the ethylene mole fraction for the $i^{th}$ fraction, which may be measured by NMR or IR as described below. $P_{AB}$ is the ethylene mole fraction of the whole ethylene/α-olefin interpolymer (before fractionation), which also may be measured by NMR or IR. $T_A$ and $P_A$ are the ATREF elution temperature and the ethylene mole fraction for pure "hard segments" (which refer to the crystalline segments of the interpolymer). As an approximation or for polymers where the "hard segment" composition is unknown, the $T_A$ and $P_A$ values are set to those for high density polyethylene homopolymer.

$T_{AB}$ is the ATREF elution temperature for a random copolymer of the same composition (having an ethylene mole fraction of $P_{AB}$) and molecular weight as the multi-block interpolymer. $T_{AB}$ may be calculated from the mole fraction of ethylene (measured by NMR) using the following equation:

$$\text{Ln } P_{AB}=\alpha/T_{AB}+\beta$$

where α and β are two constants which may be determined by a calibration using a number of well characterized preparative TREF fractions of a broad composition random copolymer and/or well characterized random ethylene copolymers with narrow composition. It should be noted that α and β may vary from instrument to instrument. Moreover, one would need to create an appropriate calibration curve with the polymer composition of interest, using appropriate molecular weight ranges and comonomer type for the preparative TREF fractions and/or random copolymers used to create the calibration. There is a slight molecular weight effect. If the calibration curve is obtained from similar molecular weight ranges, such effect would be essentially negligible. In some embodiments, random ethylene copolymers and/or preparative TREF fractions of random copolymers satisfy the following relationship:

$$\text{Ln } P=-237.83/T_{ATREF}+0.639$$

The above calibration equation relates the mole fraction of ethylene, P, to the analytical TREF elution temperature, $T_{ATREF}$, for narrow composition random copolymers and/or preparative TREF fractions of broad composition random copolymers. $T_{XO}$ is the ATREF temperature for a random copolymer of the same composition and having an ethylene mole fraction of $P_X$. $T_{XO}$ may be calculated from $\text{Ln } P_X=\alpha/T_{XO}+\beta$. Conversely, $P_{XO}$ is the ethylene mole fraction for a random copolymer of the same composition and having an ATREF temperature of $T_X$, which may be calculated from $\text{Ln } P_{XO}=a/T_X+\beta$.

Once the block index (BI) for each preparative TREF fraction is obtained, the weight average block index, ABI, for the whole polymer may be calculated. In some embodiments, ABI is greater than zero but less than about 0.4 or from about 0.1 to about 0.3. In other embodiments, ABI is greater than about 0.4 and up to about 1.0. Preferably, ABI should be in the range of from about 0.4 to about 0.7, from about 0.5 to about 0.7, or from about 0.6 to about 0.9. In some embodiments, ABI is in the range of from about 0.3 to about 0.9, from about 0.3 to about 0.8, or from about 0.3 to about 0.7, from about 0.3 to about 0.6, from about 0.3 to about 0.5, or from about 0.3 to about 0.4. In other embodiments, ABI is in the range of from about 0.4 to about 1.0, from about 0.5 to about 1.0, or from about 0.6 to about 1.0, from about 0.7 to about 1.0, from about 0.8 to about 1.0, or from about 0.9 to about 1.0.

Another characteristic of the multi-block interpolymer is that the interpolymer may comprise at least one polymer fraction which may be obtained by preparative TREF, wherein the fraction has a block index greater than about 0.1 and up to about 1.0 and the polymer having a molecular weight distribution, $M_w/M_n$, greater than about 1.3. In some embodiments, the polymer fraction has a block index greater than about 0.6 and up to about 1.0, greater than about 0.7 and up to about 1.0, greater than about 0.8 and up to about 1.0, or greater than about 0.9 and up to about 1.0. In other embodiments, the polymer fraction has a block index greater than about 0.1 and up to about 1.0, greater than about 0.2 and up to about 1.0, greater than about 0.3 and up to about 1.0, greater than about 0.4 and up to about 1.0, or greater than about 0.4 and up to about 1.0. In still other embodiments, the polymer fraction has a block index greater than about 0.1 and up to about 0.5, greater than about 0.2 and up to about 0.5, greater than about 0.3 and up to about 0.5, or greater than about 0.4 and up to about 0.5. In yet other embodiments, the polymer fraction has a block index greater than about 0.2 and up to about 0.9, greater than about 0.3 and up to about 0.8, greater than about 0.4 and up to about 0.7, or greater than about 0.5 and up to about 0.6.

Ethylene α-olefin multi-block interpolymers used in embodiments of the invention may be interpolymers of ethylene with at least one $C_3$-$C_{20}$ α-olefin. The interpolymers may further comprise $C_4$-$C_{18}$ diolefin and/or alkenylbenzene. Suitable unsaturated comonomers useful for polymerizing with ethylene include, for example, ethylenically unsaturated monomers, conjugated or non-conjugated dienes, polyenes, alkenylbenzenes, etc. Examples of such comonomers include $C_3$-$C_{20}$ α-olefins such as propylene, isobutylene, 1-butene, 1-hexene, 1-pentene, 4-methyl-1-pentene, 1-heptene, 1-octene, 1-nonene, 1-decene, and the like. 1-Butene and 1-octene are especially preferred. Other suitable monomers include styrene, halo- or alkyl-substituted styrenes, vinylbenzocyclobutane, 1,4-hexadiene, 1,7-octadiene, and naphthenics (such as cyclopentene, cyclohexene, and cyclooctene, for example).

The multi-block interpolymers disclosed herein may be differentiated from conventional, random copolymers, physical blends of polymers, and block copolymers prepared via sequential monomer addition, fluxional catalysts, and anionic or cationic living polymerization techniques. In particular, compared to a random copolymer of the same monomers and monomer content at equivalent crystallinity or modulus, the interpolymers have better (higher) heat resistance as measured by melting point, higher TMA penetration temperature, higher high-temperature tensile strength, and/or higher high-temperature torsion storage modulus as determined by dynamic mechanical analysis. As compared to a random copolymer containing the same monomers and monomer content, the multi-block interpolymers have lower compression set, particularly at elevated temperatures, lower stress relaxation, higher creep resistance, higher tear strength, higher blocking resistance, faster setup due to higher crystallization (solidification) temperature, higher recovery (particularly at elevated temperatures), better abrasion resistance, higher retractive force, and better oil and filler acceptance.

Other olefin interpolymers include polymers comprising monovinylidene aromatic monomers including styrene, o-methyl styrene, p-methyl styrene, t-butylstyrene, and the like. In particular, interpolymers comprising ethylene and styrene may be used. In other embodiments, copolymers comprising ethylene, styrene and a $C_3$-$C_{20}$ α-olefin, optionally comprising a $C_4$-$C_{20}$ diene, may be used.

Suitable non-conjugated diene monomers may include straight chain, branched chain or cyclic hydrocarbon dienes having from 6 to 15 carbon atoms. Examples of suitable non-conjugated dienes include, but are not limited to, straight chain acyclic dienes, such as 1,4-hexadiene, 1,6-octadiene, 1,7-octadiene, 1,9-decadiene, branched chain acyclic dienes, such as 5-methyl-1,4-hexadiene; 3,7-dimethyl-1,6-octadiene; 3,7-dimethyl-1,7-octadiene and mixed isomers of dihydromyricene and dihydroocinene, single ring alicyclic dienes, such as 1,3-cyclopentadiene; 1,4-cyclohexadiene; 1,5-cyclooctadiene and 1,5-cyclododecadiene, and multi-ring alicyclic fused and bridged ring dienes, such as tetrahydroindene, methyl tetrahydroindene, dicyclopentadiene, bicyclo-(2,2,1)-hepta-2,5-diene; alkenyl, alkylidene, cycloalkenyl and cycloalkylidene norbornenes, such as 5-methylene-2-norbornene (MNB); 5-propenyl-2-norbornene, 5-isopropylidene-2-norbornene, 544-cyclopentenyl)-2-norbornene, 5-cyclohexylidene-2-norbornene, 5-vinyl-2-norbornene, and norbornadiene. Of the dienes typically used to prepare EPDMs, the particularly preferred dienes are 1,4-hexadiene (HD), 5-ethylidene-2-norbornene (ENB), 5-vinylidene-2-norbornene (VNB), 5-methylene-2-norbornene (MNB), and dicyclopentadiene (DCPD).

One class of desirable polymers that may be used in accordance with embodiments disclosed herein includes elastomeric interpolymers of ethylene, a $C_3$-$C_{20}$ α-olefin, especially propylene, and optionally one or more diene monomers. Preferred α-olefins for use in this embodiment are designated by the formula $CH_2$=CHR*, where R* is a linear or branched alkyl group of from 1 to 12 carbon atoms. Examples of suitable α-olefins include, but are not limited to, propylene, isobutylenc, 1-butene, 1-pentene, 1-hexene, 4-methyl-1-pentene, and 1-octene. A particularly preferred α-olefin is propylene. The propylene based polymers are generally referred to in the art as EP or EPDM polymers. Suitable dienes for use in preparing such polymers, especially multi-block EPDM type polymers include conjugated or non-conjugated, straight or branched chain-, cyclic- or polycyclic-dienes comprising from 4 to 20 carbons. Preferred dienes include 1,4-pentadiene, 1,4-hexadiene, 5-ethylidene-2-norbornene, dicyclopentadiene, cyclohexadiene, and 5-butylidene-2-norbornene. A particularly preferred diene is 5-ethylidene-2-norbornene.

The polymers (homopolymers, copolymers, interpolymers and multi-block interpolymers) described herein may have a melt index, $I_2$, from 0.01 to 2000 g/10 minutes in some embodiments; from 0.01 to 1000 g/10 minutes in other embodiments; from 0.01 to 500 g/10 minutes in other embodiments; and from 0.01 to 100 g/10 minutes in yet other embodiments. In certain embodiments, the polymers may have a melt index, $I_2$, from 0.01 to 10 g/10 minutes, from 0.5 to 50 g/10 minutes, from 1 to 30 g/10 minutes, from 1 to 6 g/10 minutes or from 0.3 to 10 g/10 minutes. In certain embodiments, the melt index for the polymers may be approximately 1 g/10 minutes, 3 g/10 minutes or 5 g/10 minutes.

The polymers described herein may have molecular weights, $M_w$, from 1,000 g/mole to 5,000,000 g/mole in some embodiments; from 1000 g/mole to 1,000,000 in other embodiments; from 10,000 g/mole to 500,000 g/mole in other embodiments; and from 10,000 g/mole to 300,000 g/mole in yet other embodiments. The density of the polymers described herein may be from 0.80 to 0.99 g/cm$^3$ in some embodiments; for ethylene containing polymers from 0.85 g/cm$^3$ to 0.97 g/cm$^3$. In certain embodiments, the density of the ethylene/α-olefin polymers may range from 0.860 to 0.925 g/cm$^3$ or 0.867 to 0.910 g/cm$^3$.

In some embodiments, the polymers described herein may have a tensile strength above 10 MPa; a tensile strength≧11 MPa in other embodiments; and a tensile strength≧13 MPa in yet other embodiments. In some embodiments, the polymers described herein may have an elongation at break of at least 600 percent at a crosshead separation rate of 11 cm/minute; at least 700 percent in other embodiments; at least 800 percent in other embodiments; and at least 900 percent in yet other embodiments.

In some embodiments, the polymers described herein may have a storage modulus ratio, G'(25° C.)/G'(100° C.), from 1 to 50; from 1 to 20 in other embodiments; and from 1 to 10 in yet other embodiments. In some embodiments, the polymers may have a 70° C. compression set of less than 80 percent; less than 70 percent in other embodiments; less than 60 percent in other embodiments; and, less than 50 percent, less than 40 percent, down to a compression set of 0 percent in yet other embodiments.

In some embodiments, the ethylene/α-olefin interpolymers may have a heat of fusion of less than 85 J/g. In other embodiments, the ethylene/α-olefin interpolymer may have a pellet blocking strength of equal to or less than 100 pounds/foot$^2$ (4800 Pa); equal to or less than 50 lbs/ft$^2$ (2400 Pa) in other embodiments; equal to or less than 5 lbs/ft$^2$ (240 Pa), and as low as 0 lbs/ft$^2$ (0 Pa) in yet other embodiments.

In some embodiments, block polymers made with two catalysts incorporating differing quantities of comonomer may have a weight ratio of blocks formed thereby ranging from 95:5 to 5:95. The elastomeric interpolymers, in some embodiments, have an ethylene content of from 20 to 90 percent, a diene content of from 0.1 to 10 percent, and an α-olefin content of from 10 to 80 percent, based on the total weight of the polymer. In other embodiments, the multi-block elastomeric polymers have an ethylene content of from 60 to 90 percent, a diene content of from 0.1 to 10 percent, and an α-olefin content of from 10 to 40 percent, based on the total weight of the polymer. In other embodiments, the interpolymer may have a Mooney viscosity (ML (1+4) 125° C.) ranging from 1 to 250. In other embodiments, such polymers may have an ethylene content from 65 to 75 percent, a diene content from 0 to 6 percent, and an α-olefin content from 20 to 35 percent.

In certain embodiments, the polymer may be a propylene-ethylene copolymer or interpolymer having an ethylene content between 5 and 20% by weight and a melt flow rate (230° C. with 2.16 kg weight) from 0.5 to 300 g/10 min. In other embodiments, the propylene-ethylene copolymer or interpolymer may have an ethylene content between 9 and 12% by weight and a melt flow rate (230° C. with 2.16 kg weight) from 1 to 100 g/10 min.

In some particular embodiments, the polymer is a propylene-based copolymer or interpolymer. In certain embodiments, the propylene-based copolymer may be a propylene-α olefin copolymer. In some embodiments, a propylene/ethylene copolymer or interpolymer is characterized as having substantially isotactic propylene sequences. The term "substantially isotactic propylene sequences" and similar terms mean that the sequences have an isotactic triad (mm) measured by $^{13}$C NMR of greater than about 0.85, preferably greater than about 0.90, more preferably greater than about 0.92 and most preferably greater than about 0.93. Isotactic triads are well-known in the art and are described in, for example, U.S. Pat. No. 5,504,172 and WO 00/01745, which refer to the isotactic sequence in terms of a triad unit in the copolymer molecular chain as determined by $^{13}$C NMR spectra. In other particular embodiments, the ethylene-α olefin copolymer may be ethylene-butene, ethylene-hexene, or ethylene-octene copolymers or interpolymers. In other particular embodiments, the propylene-α olefin copolymer may be a propylene-ethylene or a propylene-ethylene-butene copolymer or interpolymer.

The polymers described herein (homopolymers, copolymers, interpolymers, and multi-block interpolymers) may be produced using a single site catalyst and may have a weight average molecular weight of from about 15,000 to about 5 million, such as from about 20,000 to about 1 million. The molecular weight distribution of the polymer may be from about 1.01 to about 80, such as from about 1.5 to about 40, such as from about 1.8 to about 20.

The resin may also have a relatively low melting point in some embodiments. For instance, the melting point of the polymers described herein may be less than about 160° C., such as less than 130° C., such as less than 120° C. For instance, in one embodiment, the melting point may be less than about 100° C.; in another embodiment, the melting point may be less than about 90° C.; less than 80° C. in other embodiments; and less than 70° C. in yet other embodiments.

The glass transition temperature of the polymer resin may also be relatively low. For instance, the glass transition temperature may be less than about 50° C., such as less than about 40° C.

In some embodiments, the polymer may have a Shore A hardness from 30 to 100. In other embodiments, the polymer may have a Shore A hardness from 40 to 90; from 30 to 80 in other embodiments; and from 40 to 75 in yet other embodiments.

The olefin polymers, copolymers, interpolymers, and multi-block interpolymers may be functionalized by incorporating at least one functional group in its polymer structure. Exemplary functional groups may include, for example, ethylenically unsaturated mono- and di-functional carboxylic acids, ethylenically unsaturated mono- and di-functional carboxylic acid anhydrides, salts thereof and esters thereof. Such functional groups may be grafted to an olefin polymer, or it may be copolymerized with ethylene and an optional additional comonomer to form an interpolymer of ethylene, the functional comonomer and optionally other comonomer(s). Means for grafting functional groups onto polyethylene are described for example in U.S. Pat. Nos. 4,762,890, 4,927,888, and 4,950,541, the disclosures of which are incorporated herein by reference in their entirety. One particularly useful functional group is maleic anhydride.

The amount of the functional group present in the functional polymer may vary. The functional group may be present in an amount of at least about 1.0 weight percent in some embodiments; at least about 5 weight percent in other embodiments; and at least about 7 weight percent in yet other embodiments. The functional group may be present in an amount less than about 40 weight percent in some embodiments; less than about 30 weight percent in other embodiments; and less than about 25 weight percent in yet other embodiments.

Stabilizing Agent

Embodiments disclosed herein may use one or more stabilizing agents to promote the formation of a stable dispersion or emulsion. In some embodiments, the stabilizing agent may be a surfactant, dispersing agent, emulsifier, or a polymer (different from the base polymer detailed above), or mixtures thereof. In certain embodiments, the polymer may be a polar polymer, having a polar group as either a comonomer or grafted monomer. In preferred embodiments, the stabilizing agent comprises one or more polar polyolefins, having a polar group as either a comonomer or grafted monomer. Typical polymers include ethylene-acrylic acid (EAA) and ethylene-methacrylic acid copolymers, such as those available under the trademarks PRIMACOR™ (trademark of The Dow Chemical Company), NUCREL™ (trademark of E.I. DuPont de Nemours), and ESCOR™ (trademark of ExxonMobil) and described in U.S. Pat. Nos. 4,599,392, 4,988,781, and 5,938,437, each of which is incorporated herein by reference in its entirety. Other polymers include ethylene ethyl acrylate (EEA) copolymer, ethylene methyl methacrylate (EMMA), and ethylene butyl acrylate (EBA). Other ethylene-carboxylic acid copolymers may also be used. Those having ordinary skill in the art will recognize that a number of other useful polymers may also be used.

In general, any suitable stabilizing agent can be used. In one embodiment, for instance, the stabilizing agent comprises at least one carboxylic acid, a salt of at least one carboxylic acid, or carboxylic acid ester or salt of the carboxylic acid ester. Examples of carboxylic acids useful as a dispersant comprise fatty acids such as montanic acid, stearic acid, oleic acid, and the like. In some embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some examples of salts comprise a cation selected from the group consisting of an alkali metal cation, alkaline earth metal cation, or ammonium or alkyl ammonium cation.

Other surfactants that may be used include long chain fatty acids or fatty acid salts having from 12 to 60 carbon atoms. In other embodiments, the long chain fatty acid or fatty acid salt may have from 12 to 40 carbon atoms.

If the polar group of the polymer is acidic or basic in nature, the stabilizing polymer may be partially or fully neutralized with a neutralizing agent to form the corresponding salt. In certain embodiments, neutralization of the stabilizing agent, such as a long chain fatty acid or EAA, may be from 25 to 200% on a molar basis; from 50 to 110% on a molar basis in other embodiments. For example, for EAA, the neutralizing agent is a base, such as ammonium hydroxide or potassium hydroxide, for example. Other neutralizing agents may include lithium hydroxide or sodium hydroxide, for example. Those having ordinary skill in the art will appreciate that the selection of an appropriate neutralizing agent depends on the specific composition formulated, and that such a choice is within the knowledge of those of ordinary skill in the art.

Additional surfactants that may be useful in the practice of the present invention include cationic surfactants, anionic surfactants, zwitterionic, or non-ionic surfactants. Examples of anionic surfactants include sulfonates, carboxylates, and phosphates. Examples of cationic surfactants include quaternary amines. Examples of non-ionic surfactants include block copolymers containing ethylene oxide and silicone surfactants. Surfactants useful in the practice of the present invention may be either external surfactants or internal surfactants. External surfactants are surfactants that do not become chemically reacted into the polymer during dispersion preparation. Examples of external surfactants useful herein include salts of dodecyl benzene sulfonic acid and lauryl sulfonic acid salt. Internal surfactants are surfactants that do become chemically reacted into the polymer during dispersion preparation. An example of an internal surfactant useful herein includes 2,2-dimethylol propionic acid and its salts.

In particular embodiments, the stabilizing agent or stabilizing agent may be used in an amount ranging from greater than zero to about 60% by weight based on the amount of base polymer (or base polymer mixture) used. For example, long chain fatty acids or salts thereof may be used in an amount ranging from 0.5 to 10% by weight based on the amount of base polymer. In other embodiments, ethylene-acrylic acid or ethylene-methacrylic acid copolymers may be used in an amount from 0.5 to 60% by weight based on the amount of base polymer. In yet other embodiments, sulfonic acid salts may be used in an amount from 0.5 to 10% by weight based on the amount of base polymer.

The type and amount of stabilizing agent used may also affect end properties of the article formed incorporating the dispersion. For example, articles having improved oil and grease resistance might incorporate a surfactant package having ethylene-acrylic acid copolymers or ethylene-meth-acrylic acid copolymers in an amount from about 10 to about 50% by weight based on the total amount of base polymer. A similar surfactant package may be used when improved strength or softness is a desired end property. As another example, articles having improved water or moisture resistance might incorporate a surfactant package utilizing long chain fatty acids in an amount from 0.5 to 5%, or ethylene-acrylic acid copolymers in an amount from 10 to 50%, both by weight based on the total amount of base polymer. In other embodiments, the minimum amount of surfactant or stabilizing agent must be at least 1% by weight based on the total amount of base polymer.

In other embodiments, the stabilizing agent is selected from alkyl ether carboxylates, petroleum sulfonates, sulfonated polyoxyethylenated alcohol, sulfated or phosphated polyoxyethylenated alcohols, polymeric ethylene oxide/propylene oxide/ethylene oxide stabilizing agents, primary and secondary alcohol ethoxylates, alkyl glycosides and alkyl glycerides.

When ethylene-acrylic acid copolymer is used as a stabilizing agent, the copolymer may also serve as a thermoplastic resin. In one particular embodiment, the aqueous dispersion contains an ethylene and octene copolymer, ethylene-acrylic acid copolymer, and a fatty acid, such as stearic acid or oleic acid. The stabilizing agent, such as the carboxylic acid, may be present in the aqueous dispersion in an amount from about 0.1% to about 10% by weight.

Additives

Additives may be combined with the dispersion, or with the base polymer, stabilizing agent, or filler used in the dispersion, without deviating from the scope of the present invention. For example, additives may include a wetting agent, fire retardants, surfactants, anti-static agents, antifoam agent, anti block, wax-dispersion, pigments, a neutralizing agent, a thickener, a compatibilizer, a brightener, a rheology modifier, a biocide, a fungicide, reinforcing fibers, and other additives known to those skilled in the art. While optional for purposes of the present invention, other components may be highly advantageous for product stability during and after the manufacturing process.

Additives and adjuvants may be included in any formulation comprising the above described polymers, copolymers, interpolymers, and multi-block interpolymers. Suitable additives include fillers, such as organic or inorganic particles, including clays, talc, titanium dioxide, zeolites, powdered metals, organic or inorganic fibers, including carbon fibers, silicon nitride fibers, steel wire or mesh, and nylon or polyester cording, nano-sized particles, clays, and so forth; tackifiers, oil extenders, including paraffinic or napthelenic oils; and other natural and synthetic polymers, including other polymers according to embodiments of the invention. Thermoplastic compositions according to other embodiments of the invention may also contain organic or inorganic fillers or other additives such as starch, talc, calcium carbonate, glass fibers, polymeric fibers (including nylon, rayon, cotton, polyester, and polyaramide), metal fibers, flakes or particles, expandable layered silicates, phosphates or carbonates, such as clays, mica, silica, alumina, aluminosilicates or aluminophosphates, carbon whiskers, carbon fibers, nanoparticles including nanotubes, wollastonite, graphite, zeolites, and ceramics, such as silicon carbide, silicon nitride, or titania. Silane-based or other coupling agents may also be employed for better filler bonding.

Polymers suitable for blending with the above described polymers include thermoplastic and non-thermoplastic polymers including natural and synthetic polymers. Exemplary polymers for blending include ethylene-vinyl acetate (EVA), ethylene/vinyl alcohol copolymers, polystyrene, impact modified polystyrene, ABS, styrene/butadiene block copolymers and hydrogenated derivatives thereof (SBS and SEBS), and thermoplastic polyurethanes.

Suitable conventional block copolymers which may be blended with the polymers disclosed herein may possess a Mooney viscosity (ML 1+4 @ 100° C.) in the range from 10 to 135 in some embodiments; from 25 to 100 in other embodiments; and from 30 to 80 in yet other embodiments. Suitable polyolefins especially include linear or low density polyethylene, polypropylene (including atactic, isotactic, syndiotactic and impact modified versions thereof) and poly(4-methyl-1-pentene). Suitable styrenic polymers include polystyrene, rubber modified polystyrene (HIPS), styrene/acrylonitrile copolymers (SAN), rubber modified SAN (ABS or AES) and styrene maleic anhydride copolymers.

The blend compositions may contain processing oils, plasticizers, and processing aids. Rubber processing oils having a certain ASTM designation and paraffinic, napthenic or aromatic process oils are all suitable for use. Generally from 0 to 150 parts, more preferably 0 to 100 parts, and most preferably from 0 to 50 parts of processing oils, plasticizers, and/or processing aids per 100 parts of total polymer are employed. Higher amounts of oil may tend to improve the processing of the resulting product at the expense of some physical properties. Additional processing aids include conventional waxes, fatty acid salts, such as calcium stearate or zinc stearate, (poly)alcohols including glycols, (poly)alcohol ethers, including glycol ethers, (poly)esters, including (poly)glycol esters, and metal salts, especially Group 1 or 2 metal or zinc salts and derivatives thereof.

For conventional TPO, TPV, and TPE applications, carbon black is one additive useful for UV absorption and stabilizing properties. Representative examples of carbon blacks include ASTM N110, N121, N220, N231, N234, N242, N293, N299, S315, N326, N330, M332, N339, N343, N347, N351, N358, N375, N539, N550, N582, N630, N642, N650, N683, N754, N762, N765, N774, N787, N907, N908, N990 and N991. These carbon blacks have iodine absorptions ranging from 9 to 145 g/kg and average pore volumes ranging from 10 to 150 $cm^3$/100 g. Generally, smaller particle sized carbon blacks are employed, to the extent cost considerations permit. For many such applications the present polymers and blends thereof require little or no carbon black, thereby allowing considerable design freedom to include alternative pigments or no pigments at all.

Compositions, including thermoplastic blends according to embodiments of the invention may also contain anti-ozonants or anti-oxidants that are known to a rubber chemist of ordinary skill. The anti-ozonants may be physical protectants such as waxy materials that come to the surface and protect the part from oxygen or ozone or they may be chemical protectors that react with oxygen or ozone. Suitable chemical protectors include styrenated phenols, butylated octylated phenol, butylated di(dimethylbenzyl) phenol, p-phenylenediamines, butylated reaction products of p-cresol and dicyclopentadiene (DCPD), polyphenolic anitioxidants, hydroquinone derivatives, quinoline, diphenylene antioxidants, thioester antioxidants, and blends thereof. Some representative trade names of such products are WINGSTAY™ S antioxidant, POLYSTAY™ 100 antioxidant, POLYSTAY™ 100 AZ antioxidant, POLYSTAY™ 200 antioxidant, WINGSTAY™ L antioxidant, WINGSTAY™ LHLS antioxidant, WINGSTAY™ K antioxidant, WINGSTAY™ 29 antioxidant, WINGSTAY™ SN-1 antioxidant, and IRGANOX™ antioxidants. In some applications, the anti-oxidants and anti-ozonants used will preferably be non-staining and non-migratory.

For providing additional stability against UV radiation, hindered amine light stabilizers (HALS) and UV absorbers may be also used. Suitable examples include TINUVIN™ 123, TINUVIN™ 144, TINUVIN™ 622, TINUVIN™ 765, TINUVIN™ 770, and TINUVIN™ 780, available from Ciba Specialty Chemicals, and CHEMISORB™ T944, available from Cytex Plastics, Houston, Tex., USA. A Lewis acid may be additionally included with a HALS compound in order to achieve superior surface quality, as disclosed in U.S. Pat. No. 6,051,681. Other embodiments may include a heat stabilizer, such as IRGANOX™ PS 802 FL, for example.

For some compositions, additional mixing processes may be employed to pre-disperse the heat stabilizers, anti-oxidants, anti-ozonants, carbon black, UV absorbers, and/or light stabilizers to form a masterbatch, and subsequently to form polymer blends therefrom.

Suitable crosslinking agents (also referred to as curing or vulcanizing agents) for use herein include sulfur based, peroxide based, or phenolic based compounds. Examples of the foregoing materials are found in the art, including in U.S. Pat. Nos. 3,758,643, 3,806,558, 5,051,478, 4,104,210, 4,130,535, 4,202,801, 4,271,049, 4,340,684, 4,250,273, 4,927,882, 4,311,628, and 5,248,729.

When sulfur based curing agents are employed, accelerators and cure activators may be used as well. Accelerators are used to control the time and/or temperature required for dynamic vulcanization and to improve the properties of the resulting cross-linked article. In one embodiment, a single accelerator or primary accelerator is used. The primary accelerator(s) may be used in total amounts ranging from about 0.5 to about 4, preferably about 0.8 to about 1.5 phr, based on total composition weight. In another embodiment, combinations of a primary and a secondary accelerator might be used with the secondary accelerator being used in smaller amounts, such as from about 0.05 to about 3 phr, in order to activate and to improve the properties of the cured article. Combinations of accelerators generally produce articles having properties that are somewhat better than those produced by use of a single accelerator. In addition, delayed action accelerators may be used which are not affected by normal processing temperatures yet produce a satisfactory cure at ordinary vulcanization temperatures. Vulcanization retarders might also be used. Suitable types of accelerators that may be used in the present invention are amines, disulfides, guanidines, thioureas, thiazoles, thiurams, sulfenamides, dithiocarbamates, and xanthates. Preferably, the primary accelerator is a sulfenamide. If a second accelerator is used, the secondary accelerator is preferably a guanidine, dithiocarbamate, or thiuram compound. Certain processing aids and cure activators such as stearic acid and ZnO may also be used. When peroxide based curing agents are used, co-activators or coagents may be used in combination therewith. Suitable coagents include trimethylolpropane triacrylate (TMPTA), trimethylolpropane trimethacrylate (TMPTMA), triallyl cyanurate (TAC), and triallyl isocyanurate (TAIL), among others. Use of peroxide crosslinkers and optional coagents used for partial or complete dynamic vulcanization are known in the art and disclosed, for example, in "Peroxide Vulcanization of Elastomer," Vol. 74, No 3, July-August 2001.

When the polymer composition is at least partially crosslinked, the degree of crosslinking may be measured by dissolving the composition in a solvent for specified duration, and calculating the percent gel or unextractable component. The percent gel normally increases with increasing crosslinking levels. For cured articles according to embodiments of the invention, the percent gel content is desirably in the range from 5 to 100 percent.

In some embodiments, additives may also include perfumes, algae inhibitors, anti-microbiological and anti-fungus agents, flame retardants and halogen-free flame retardants, as well as slip and anti-block additives. Other embodiments may include PDMS to decrease the abrasion resistance of the polymer. Adhesion of the polymer may also be improved through the use of adhesion promoters or functionalization or coupling of the polymer with organosilane, polychloroprene (neoprene), or other grafting agents.

Overall Dispersion Characteristics/Properties

In addition to the above components, the aqueous dispersion also contains water. Water may be added as deionized water, if desired. The pH of the aqueous dispersion is generally less than about 12, such as from about 5 to about 11.5, such as from about 7 to about 11. The aqueous dispersion may have a solids content of less than about 75%, such as less than about 70%. For instance, the solids content of the aqueous dispersion may range from about 5% to about 60%. In general, the solids content can be varied depending upon the manner in which the additive composition is applied or incorporated with the particulate substrate.

Aqueous dispersions, for example, may be formed using a base polymer, as described above, a stabilizing agent, and water. Froths and foams comprising the polymers may also be formed, as disclosed in PCT Application No. PCT/US2004/027593, filed Aug. 25, 2004, and published as WO2005/021622. The polymers may also be crosslinked by any known means, such as the use of peroxide, electron beam, silane, azide, gamma irradiation or other cross-linking techniques. The polymers may also be chemically modified, such as by grafting (for example by use of maleic anhydride (MAH), silanes, or other grafting agent), halogenation, amination, sulfonation, or other chemical modification.

Dispersions formed in accordance with embodiments disclosed herein may include: a base polymer, which may comprise at least one olefin polymer; and a stabilizing agent, which may comprise at least one polar polyolefin. The olefin polymer, in some embodiments, may be a propylene-based homopolymer, copolymer, interpolymer, or multi-block interpolymer. In other embodiments, the olefin polymer may be an ethylene-based homopolymer, copolymer, interpolymer, or multi-block interpolymer. In other embodiments, the olefin polymer may be a combination of one or more olefin polymers described herein.

With respect to the base polymer and the stabilizing agent, in some embodiments, the base polymer may comprise between about 30 percent to about 99 percent by weight of the total amount of base polymer and stabilizing agent in the composition. In other embodiments, the base polymer may comprise between about 50 percent and about 90 percent of the total amount of base polymer and stabilizing agent in the composition. In yet other embodiments, the one or more base polymers may comprise between about 60 percent and about 80 percent of the total amount of base polymer and stabilizing agent in the composition.

The one or more olefin resins may be contained within the aqueous dispersion in an amount from about 1 percent by weight to about 96 percent by weight. In some embodiments, the olefin polymer may be present in the aqueous dispersion in an amount from about 10 percent by weight to about 80 percent by weight. In other embodiments, the olefin polymer may be present in an amount from about 20 percent to about 70 percent by weight; and, from about 30 percent to about 60 percent by weight in yet other embodiments.

Dispersions formed in accordance with embodiments disclosed herein may include: a base polymer, which may include at least one olefin polymer as described above; a secondary polymeric component, which may include at least one thermoplastic polyolefin; and a stabilizing agent. The at least one olefin polymer, in some embodiments, may comprise from about 30 percent to 95 percent by weight of the total amount of base polymer, secondary polymer, and stabilizing agent in the composition. In other embodiments, the at least one olefin polymer may comprise between about 50 percent and about 80 percent by weight; and, between about 60 percent to about 70 percent by weight in yet other embodiments. In some embodiments, the secondary polymeric component may comprise from 1 to 48 percent by weight of the total amount of base polymer, secondary polymer, and stabilizing agent in the composition. In other embodiments, the secondary polymeric component may comprise from 5 to 30 percent by weight; and from 10 to 25 percent by weight in yet other embodiments.

Benefits derived from an olefin polymer may also be realized where the polymer is used as a minority component in a dispersion. Accordingly, dispersions formed in accordance with other embodiments disclosed herein may include: a base polymer, which may include at least one thermoplastic polyolefin; a secondary polymeric component, which may include at least one olefin polymer or interpolymer as described above; and a stabilizing agent. The base polymer, in some embodiments, may comprise from about 30 percent to 95 percent by weight of the total amount of base polymer, olefin polymer or interpolymer, and stabilizing agent in the composition. In other embodiments, the base polymer may comprise between about 50 percent and about 80 percent by weight; and, between about 60 percent to about 70 percent by weight in yet other embodiments. In other embodiments, the olefin polymer component may comprise from 1 to 48 percent by weight of the total amount of base polymer, olefin polymer, and stabilizing agent in the composition. In other embodiments, the olefin polymer component may comprise from 5 to 30 percent by weight; and from 10 to 25 percent by weight in yet other embodiments.

With respect to the filler, typically, an amount greater than about 0 to about 1000 parts per hundred of the polymer (polymer meaning here the base polymer combined with the thermoplastic polymer (if any) and the stabilizing agent) is used. In selected embodiments, between about 50 to 250 parts per hundred are used. In other selected embodiments, between about 10 to 500 parts per hundred are used. In still other embodiments, from between about 20 to 400 parts per hundred are used. In other embodiments, from about 0 to about 200 parts per hundred are used.

The solid materials (base polymer plus thermoplastic polymer (if any) plus stabilizing agent) are preferably dispersed in a liquid medium, which in preferred embodiments is water. In preferred embodiments, sufficient neutralization agent is added to neutralize the resultant dispersion to achieve a pH range of between about 4 to about 14. In preferred embodiments, sufficient base is added to maintain a pH of between about 6 to about 11; in other embodiments, the pH may be between about 8 to about 10.5. Water content of the dispersion is preferably controlled so that the solids content is between about 1% to about 74% by volume. In another embodiment, the solids content is between about 25% to about 74% by volume. In particular embodiments, the solids range may be between about 10% to about 70% by weight. In other particular embodiments, the solids range is between about 20% to about 60% by weight. In particularly preferred embodiments, the solids range is between about 30% to about 55% by weight.

Dispersions formed in accordance with embodiments of the present invention are characterized in having an average particle size of between about 0.1 to about 5.0 microns. Broadly speaking, however, they may have a dispersed particle size of greater than about 0 to about 10 microns. In other embodiments, dispersions have an average particle size of from about 0.5 μm to about 2.7 μm. In other embodiments, from about 0.8 μm to about 1.2 μm. By "average particle size," the present invention means the volume-mean particle size. In order to measure the particle size, laser-diffraction techniques may be employed for example. A particle size in this description refers to the diameter of the polymer in the dispersion. For polymer particles that are not spherical, the diameter of the particle is the average of the long and short axes of the particle. Particle sizes may be measured on a Beckman-Coulter LS230 laser-diffraction particle size analyzer or other suitable device. The particle size distribution of the polymer particles in the dispersion may be less than or equal to about 2.0, such as less than 1.9, 1.7 or 1.5.

In addition, embodiments of the present invention optionally include a filler wetting agent. A filler wetting agent generally may help make the filler and the polyolefin dispersion more compatible. Useful wetting agents include phosphate salts, such as sodium hexametaphosphate. A filler wetting agent may be included in a composition of the present invention at a concentration of at least about 0.5 parts per 100 parts of filler, by weight.

Furthermore, embodiments of the present invention may optionally include a thickener. Thickeners may be useful in the present invention to increase the viscosity of low viscosity dispersions. Thickeners suitable for use in the practice of the present invention may be any known in the art such as for instance polyacrylate type or associated non ionic thickeners such as modified cellulose ethers. For example, suitable thickeners include ALCOGUM™ VEP-II (trademark of Alco Chemical Corporation), RHEOVIS™ and VISCALEX™ (trademarks of Ciba Ceigy), UCAR® Thickener 146, ETHOCEL™, or METHOCEL™ (trademarks of the The Dow Chemical Company), PARAGUM™ 241 (trademarks of Para-Chem Southern, Inc.), BERMACOL™ (trademark of Akzo Nobel), AQUALON™ (trademark of Hercules), and ACUSOL® (trademark of Rohm and Haas). Thickeners may be used in any amount necessary to prepare a dispersion of desired viscosity.

The ultimate viscosity of the dispersion is, therefore, controllable. Addition of the thickener to the dispersion including the amount of filler may be done with conventional means to result in viscosities as needed. Viscosities of the dispersions may reach +3000 cP (Brookfield spindle 4 with 20 rpm) with moderate thickener dosing (up to 4%, preferably below 3%, based on 100 phr of polymer dispersion). The starting polymer dispersion as described has an initial viscosity prior to formulation with fillers and additives between 20 and 1000 cP (Brookfield viscosity measured at room temperature with spindle RV3 at 50 rpm). Still more preferably, the starting viscosity of the dispersion may be between about 100 to about 600 cP.

Also, embodiments of the present invention are characterized by their stability when a filler is added to the polymer/stabilizing agent. In this context, stability refers to the stability of viscosity of the resultant aqueous polyolefin dispersion. In order to test the stability, the viscosity is measured over a period of time. Preferably, viscosity measured at 20° C.

should remain+/−10% of the original viscosity over a period of 24 hours, when stored at ambient temperature.

Examples of aqueous dispersions that may be incorporated into embodiments of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

Dispersion Formation

Dispersions used in embodiments disclosed herein may be formed by any number of methods recognized by those having skill in the art. In selected embodiments, the dispersions may be formed by using techniques, for example, in accordance with the procedures as described in WO2005021638, which is incorporated by reference in its entirety.

While any method may be used to produce the aqueous dispersion, in one embodiment, the dispersion may be formed through a melt-kneading process. For example, the kneader may comprise a BANBURY® mixer, single-screw extruder, or a multi-screw extruder. The melt-kneading may be conducted under the conditions which are typically used for melt-kneading the one or more thermoplastic resins.

In one particular embodiment, the process includes melt-kneading the components that make up the dispersion. The melt-kneading machine may include multiple inlets for the various components. For example, the extruder may include four inlets placed in series. Further, if desired, a vacuum vent may be added at an optional position of the extruder.

In a specific embodiment, a base polymer, a stabilizing agent, and optionally a finer are melt-kneaded in an extruder along with water and a neutralizing agent, such as ammonia, potassium hydroxide, or a combination of the two to form a dispersion. Those having ordinary skill in the art will recognize that a number of other neutralizing agents may be used. In some embodiments, the filler may be added after blending the base polymer and stabilizing agent. In some embodiments, the dispersion is first diluted to contain about 1 to about 3% by weight water and then, subsequently, further diluted to comprise greater than about 25% by weight water.

Any melt-kneading means known in the art may be used. In some embodiments, a kneader, a BANBURY® mixer, single-screw extruder, or a multi-screw extruder is used. A process for producing the dispersions in accordance with the present invention is not particularly limited. One preferred process, for example, is a process comprising melt-kneading the above-mentioned components according to U.S. Pat. No. 5,756,659 and U.S. Pat. No. 6,455,636.

An extrusion apparatus that may be used in embodiments of the invention may be described as follows. An extruder, in certain embodiments a twin screw extruder, is coupled to a back pressure regulator, melt pump, or a gear pump. Embodiments also provide a base reservoir and an initial water reservoir, each of which includes a pump. Desired amounts of base and initial water are provided from the base reservoir and the initial water reservoir, respectively. Any suitable pump may be used, but in some embodiments a pump that provides a flow of about 150 cc/min at a pressure of 240 bar is used to provide the base and the initial water to the extruder. In other embodiments, a liquid injection pump provides a flow of 300 cc/min at 200 bar or 600 cc/min at 133 bar. In some embodiments, the base and initial water are preheated in a preheater.

Polymer resin(s), in the form of pellets, powder, or flakes, for example, is fed from the feeder to an inlet of the extruder where the resin is melted or compounded. In some embodiments, the stabilizing agent is added to the resin through and along with the resin and in other embodiments, the stabilizing agent is provided separately to the twin screw extruder. The resin melt is then delivered from the mix and convey zone to an emulsification zone of the extruder where the initial amount of water and base from the reservoirs is added through the inlet. In some embodiments, stabilizing agent may be added additionally or exclusively to the water stream.

In some embodiments, the emulsified mixture is further diluted with additional water inlet from the reservoir in a dilution and cooling zone of the extruder. Typically, the dispersion is diluted to at least 30 weight percent water in the cooling zone. In addition, the diluted mixture may be diluted any number of times until the desired dilution level is achieved. In some embodiments, water is not added into the twin screw extruder but rather to a stream containing the resin melt after the melt has exited from the extruder. In this manner, steam pressure build-up in the extruder is eliminated.

In particular embodiments, it may be desired to utilize the dispersion in the form of foam. When preparing foams, it is often preferred to froth the dispersion. For example, froths and foams may be prepared as described in WO2005021622, which is fully incorporated herein by reference. Preferred in the practice of this invention is the use of a gas as a frothing agent. Examples of suitable frothing agents include: gases and/or mixtures of gases such as, air, carbon dioxide, nitrogen, argon, helium, and the like. Particularly preferable is the use of air as a frothing agent. Frothing agents are typically introduced by mechanical introduction of a gas into a liquid to form a froth. This technique is known as mechanical frothing. In preparing a frothed dispersion, it is preferred to mix all components and then blend the air or gas into the mixture, using equipment such as an OAKES, MONDO, or FIRESTONE frother.

Surfactants useful for preparing a stable froth are referred to herein as foam stabilizers. Foam stabilizers are useful in the practice of the present invention. Those having ordinary skill in this field will recognize that a number of foam stabilizers may be used. Foam stabilizers may include, for example, sulfates, succinamates, and sulfosuccinamates.

Articles

Final articles formed using the dispersions disclosed above can take a number of forms, and employ a number of components. They may also include a number of other layers, but generally include a nonwoven layer as a substrate. In a glove or foot wear, for instance, the nonwoven layer may serve as either an underglove or a lining for barrier layer and elastomeric overcoat. The nonwoven fiber layer web separates and keeps the elastomeric material away from skin. A common problem associated with the wearing of articles or garments made from natural rubber latex over enclosed skin is the development of various skin allergies (e.g., irritant dermatitis, delayed cutaneous hypersensitivity (Type IV allergy), and immediate reaction (Type I allergy)) that are believed to be caused by proteins in the rubber latex. By using a non-woven liner, such allergy reactions can be minimized and/or eliminated by avoiding direct contact of skin with latex. Instead of being in contact with the latex rubber, a barrier will protect the wearer's skin, which will touch an inner surface that has a non-woven layer of long continguous fiber strands.

The non-woven liner can provide a soft cloth or "cotton-like" feel that is significantly more comfortable for the wearer than direct skin contact with latex or plastic films. A non-woven liner also provides additional advantages over unlined or naked latex gloves by absorbing moisture, and eliminating the convention requisite for specialized donning coats. Since a nonwoven fabric has a lower coefficient of friction relative to plastic films or latex membranes, a glove with an inner lining of nonwoven fabric can facilitate donning or doffing of the glove, permitting the user to easily slip a hand in or out of the glove.

Various types of polymer-based materials from the art may be used to make cloth-like non-woven fabrics. A foundational substrate or base nonwoven fiber web can be formed from materials that may include, for instance, synthetic fibers, pulp fibers, thermo-mechanical pulp, or mixtures of such materials such that the web has cloth-like properties. A flexible sheet material can be used to form the non-woven webs. Non-woven web materials suitable for use in the invention may be, for example, selected from a group consisting of spunbond, meltblown, spunbond-meltblown-spunbond laminates, coform, spunbond-film-spunbond laminates, bicomponent spunbond, bicomponent meltblown, biconstituent spunbond, biconstituent meltblown, bonded carded bicomponent web, crimped fibers, airlaid, and combinations thereof.

The base web can also include various elastomeric components, such as elastic laminates or film laminates. For example, suitable elastic laminates can include stretch-bonded and neck-bonded laminates. Alternatively, fibrous nonwoven webs formed by extrusion processes such as spunbonding and meltblowing, and by mechanical dry-forming process such as air-laying and carding, used in combination with thermoplastic film or microfiber layers, may be utilized as components. Since the materials and manufacture of these components of the present invention are often inexpensive relative to the cost of woven or knitted components, the products can be disposable.

Films in general and elastic layers in particular, whether a film sheet layer or a microfiber layer, often have unpleasant tactile aesthetic properties, such as feeling rubbery or tacky to the touch, making them unpleasant and uncomfortable against the wearer's skin. Fibrous non-woven webs, on the other hand, have better tactile, comfort and aesthetic properties.

An article formed in accordance with embodiments disclosed herein may include an elastic component, such as to provide a glove or foot covering with form-fitting properties. For instance, a glove formed with an elastic component can snuggly fit onto a person's hand so that the glove can more effectively remain on the hand. The barrier film is adapted to remain "breathable" to aid in a person's comfort during use, while also remaining capable of substantially inhibiting the transfer of liquids from the outer surface of the glove to the person's hand.

The barrier layer can include a moisture barrier that is incorporated into or applied to the foundational substrate or base nonwoven web. In general, a moisture barrier refers to any barrier, layer or film that is relatively liquid-impervious. In particular, the moisture barrier of the present invention can prevent the flow of liquid through the glove so that the hand inserted therein remains dry when the glove is being used. In some embodiments, the moisture barrier can remain breathable, i.e., permeable to vapors, such that the hand within the glove is more comfortable. Examples of suitable moisture barriers can include films, fibrous materials, laminates, and the like. In particular, a layer of film or microfibers may be used to impart liquid barrier properties, and an elastic layer (e.g., elastic film or elastic microfibers) may be used to impart additional properties of stretch and recovery.

The tactile aesthetic properties of elastic films can be improved by forming a laminate of an elastic film with one or more non-elastic materials, such as fibrous non-woven webs, on the outer surface of the elastic material. Fibrous non-woven webs formed from non-elastic polymers, such as, for example polyolefins, however, are generally considered non-elastic and may have poor extensibility, and when non-elastic non-woven webs are laminated to elastic materials the resulting laminate may also be restricted in its elastic properties. Therefore, laminates of elastic materials with non-woven webs have been developed wherein the non-woven webs are made extensible by processes such as necking or gathering.

In accordance with the present invention, the non-woven fiber web can be porous and its fiber surface can be further modified to have a variety of different surface functionalities. For example, pores associated with the fiber web can be used as a carrier for a variety of treatments in which various additives can be applied, if desired, to the whole or part of the glove before use. When used as a protection garment for dry skin, wounds, cuts, bruises, blisters, odor control, keeping hand or foot warm, etc., various additives can be applied to the glove to aid for therapeutic purposes. Examples of such articles may include disposable, exam, surgical, clean room, work, and/or industrial protection gloves where added strength, comfort, skin protection, and powder-free aspects are desirable characteristics. For example, an article of the present invention can generally include additives such as antibiotics, anti-microbial agents, anti-inflammatory agents, NEOSPORIN, moisturizing agents, cationic polymers, and the like. In addition, when used as a glove for treating other ailments, such as arthritis, "black toe," "trigger finger," or jammed, sprained, hyper-extended, dislocated, or broken appendages, a glove of the present invention can generally include various other additives, such as topical analgesics (e.g. BEN-GAY®), anti-inflammatory agents, vasodilators, corticosteroids, dimethyl sulfoxide (DMSO), capsaicin, menthol, methyl salicylate, DMSO/capsaicin, cationic polymers, anti-fungal agents, and the like.

Additives can be applied to a glove of the present invention in the form of an aqueous solution, non-aqueous solution (e.g., oil), lotions, creams, suspensions, gels, etc. When utilized, the aqueous solution can, for example, be coated, sprayed, saturated, or impregnated into the glove. In some embodiments, the additives can be applied asymmetrically. Moreover, in some instances, it may be desired that the additives comprise less than about 100% by weight of the glove, and in some embodiments, less than about 50% by weight of the glove and particularly less than 10% by weight of the glove, and in some embodiments, less than about 5% by weight of the glove, and in some embodiments, less than about 1% by weight of the glove. It should be noted that any given range presented herein in intended to include any and all lesser included ranges. For example, a range from 45 to 90 would also include 50 to 90; 45.5 to 80; 75-89 and the like. In some embodiments, the glove may be treated with above said additives to only certain areas, particularly in areas that are desired to be treated. For example, a glove can have additives in only finger areas for being used as a finger appendage.

The non-woven web materials are preferably formed with polymers selected from the group including: polyolefins, polyamides, polyesters, polycarbonates, polystyrenes, thermoplastic elastomers, fluoropolymers, vinyl polymers, and blends and copolymers thereof. Suitable polyolefins include, but are not limited to, polyethylene, polypropylene, polybutylene, and the like; suitable polyamides include, but are not limited to, nylon 6, nylon 6/6, nylon 10, nylon 12 and the like; and suitable polyesters include, but are not limited to, polyethylene terephthalate, polybutylene terephthalate and the like. Particularly suitable polymers for use in the present invention are polyolefins including polyethylene, for example, linear low density polyethylene, low density polyethylene, medium density polyethylene, high density polyethylene and blends thereof; polypropylene; polybutylene;

and copolymers as well as blends thereof. Additionally, the suitable fiber forming polymers may have thermoplastic elastomers blended therein.

Non-woven fabrics which are used in such laminates, prior to conversion into such laminates, desirably have a basis weight between about 10 g/m$^2$ and 50 g/m$^2$ and even more desirably between about 12 g/m$^2$ and 25 g/m$^2$. In an alternative embodiment such non-woven fabrics have a basis weight between about 15 g/m$^2$ and 20 g/m$^2$.

Another flexible sheet material that may be used include polymeric films, which provide a barrier to fluids while remaining flexible. The films can be either micro-porous or monolithic. Micro-porous or monolithic films can be combined in the construction of the present protective articles. For instance, depending on the desired properties or use, one part of a gloves or foot cover can be made with micro-porous films (e.g., back of the hand of a glove, or upper body of a foot cover) while another part can be made with a monolithic film (e.g., palm and fingers, or foot sole), since each respective area of the article will have different demands place on its function and it may come in contact with different environmental conditions. In certain variations, to illustrate, often the palm and finger areas of a glove, like the sole of a foot covering, will be exposed to much wear and tear against abrasion or hard surfaces, as well as chemical or biological hazards, hence they need to be both resilient and impermeable to protect the wearer. In contrast, the back of the hand and upper body of a foot cover are relatively sheltered from harsh use of treatment, hence a more breathable films is more suited. Examples of such films are described in WO 96/19346 to McCormack et al., incorporated herein by reference in its entirety. Also because of the exposure to abrasion, the palm and fingers of a glove can have a further elastomeric polymer overcoat to strength the barrier layers or protect the underlying nonwoven-laminate body of the glove or foot cover.

While it should be recognized that flexible sheet materials can be chosen from a broad spectrum of materials, non-woven webs and polymeric films are used hereunder for illustrative purposes. When a machine direction tension force is applied to an elastic film sheet, the force will cause the elastic film sheet to be stretched or elongated in the machine direction. Because the film sheet is elastic, when the tension is removed or relaxed the film will retract toward its original machine direction length. When the film retracts or becomes shorter in the machine direction, first fibrous nonwoven web and/or second fibrous nonwoven web which are bonded to the side or sides of the elastic film will buckle or form gathers. The gathers can be applied to form a cuff around an open end of the present protective articles. The resulting elastic laminate material is stretchable in the machine direction to the extent that the gathers or buckles in the fibrous nonwoven web or webs can be pulled back out flat and allow the elastic film to elongate.

Formulation Characteristics

In accordance with embodiments disclosed herein, the present inventors have discovered that the type of polyolefin used in the aqueous dispersion may be significant in the end breathability of the article. Specifically, higher MFI polymers can be more easily spread over the whole substrate surface at the drying temperature, forming a compact homogeneous layer and reducing the breathability. Moreover, the type of polyolefin used in the aqueous dispersion may have an effect on the MVTR, as higher crystallinity polymers are expected to improve the MVTR. Similarly, higher MFI polymers are expected to have less of a tendency to form "pinholes," or to form excessive pores during drying, leading to a more uniform coating. Obviously, those of ordinary skill in the art will appreciate that the type of polymer selected will determine the temperature at which a stable, breathable structure can be created.

The present inventors have also advantageously found that the type of base used in neutralization of the dispersion may be significant. Residual non-volatile base can increase the articles breathability.

As noted above, because embodiments disclosed herein employ an aqueous dispersion, the coating of a non-woven substrate may be achieved in a number of different manners. For example, an industrial curtain coating method may be used that allows for the coating of substrates at high speeds (100-1100 m/min). As an alternative method, a film transfer technique, which may include a first film fabrication on a flat, non-porous substrate, subsequent film transfer, and lamination to a final substrate may be employed.

Multi-coating (i.e., repeating coating of the same substrate with the dispersion, or with different materials) can help overcome difficulties with covering either rough or large pore substrates. These techniques may also introduce new functions to the coating, such as color, adhesion to another substrate, soft touch, odor acceptance, etc.

As noted above, inorganic or organic fillers (e.g., calcium carbonate) may be employed as a co-component in the aqueous dispersion, or as a major component of a primer layer applied below the dispersion coating to smooth the substrate. A crosslinking agent may be added to provide partial or complete crosslinking of one or more of the polymers in the aqueous dispersion. Crosslinking one or more of the polymers may have the effect of improving the MVTR of the article.

In addition, the substrate may be functionalized in order to tailor the end use article. For example, the substrate may be subjected to corona treatment, (i.e., subjected to an electrical discharge), which may improve the coating quality.

EXAMPLES

Aqueous Dispersions

Dispersion 1:

POD 1 is an aqueous polyolefin dispersion DPOD 8501 (Developmental Polyolefin Dispersion) batch UJ2655WC30 available from The Dow Chemical Company. POD 1 is formed using a ethylene-octene copolymer (ENGAGE™ 8200, available from The Dow Chemical Company, having a $I_2$ of 5.0 dg/min (190° C., 2.16 kg, ASTM D 1238) and a density of 0.870 g/cc). The surfactant system used is PRIMACOR™ 59801 (an ethylene acrylic acid copolymer available from The Dow Chemical Company). PRIMACOR™ is used at a loading of 30 weight percent based on the weight of the ethylene-octene copolymer.

POD 1 (DPOD 8501, batch UJ2655WC30) is a large scale market development sample product produced by Dow Material Transforamtion Group (MTG) Process Development Center (PDC) in Weston Canal, USA, using standardized procedure, common manufacturing documentation and the following manufacturing hardware and setups: Twin Screw Extruder (TSE) Coperion Werner & Pfleiderer ZSK-58 (250 bhp motor, 1200 rpm max speed, 12 barrels, Screw 009), Two (2) ITT shell and tube heat exchangers (Model No. 5-160-03-036-005, 11 ft2 surface area; 3 inch by 36 inch)—56 tubes, ¼ inch OD stainless steel tubes (wall thickness 0.022 inch), four (4) pass with narrow baffle spacing on shell side, process connected in series, cooling water connected in parallel, Rosedale Model 6 Basket Strainer and Bag Filter, stainless steel construction Model No. MC6181P 150SVPBD, polyester filter bag with 300 micron rating.

The POD batch used has a solids content of 44.4 weight percent (determined by DOWM 102168-E06A), a pH of 9.7 (determined by DOWM 102159-E05A), and a Brookfield viscosity of 199 centipoise (Spindle 1 @ 20 rpm; determined by DOWM 102166-E05A). The dispersed polymer phase particle average volume diameter is 1.1 microns (measured by DOWM 102167-E06A).

Dispersion 2:

POD 2 is formed in accordance with the procedures as described in WO2005021638 using an ethylene-octene copolymer (ENGAGE™ 8200, available from The Dow Chemical Company, having a $I_2$ of 5.0 dg/min and a density of 0.870 g/cc). The surfactant system used is PRIMACOR™ 59801 (as described above). PRIMACOR™ is used at a loading of 30 weight percent based on the weight of the ethylene-octene interpolymer.

The ethylene-octene copolymer is dry blended with the surfactant. The mixture is then extruded at 76.6 g/min using a Berstorff ZE25 (36 L/D, 458 rpm) and a Schenck Mechatron loss-in-weight feeder. An ISCO dual-syringe pump meters a 28-30% (w/w; ~14.8 Normal) ammonium hydroxide solution directly from the stock bottle at 3.99 cc/min, while ISCO dual-syringe pumps meter in the Initial Water at 22 cc/min (blended with the base solution before entering the initial aqueous (IA) injector) and Dilution water at 60 cc/min. Each aqueous stream is pumped into the twin-screw extruder though a tappet style injector designed by the Dow Material Engineering Center. The Initial water stream is pre-heated to 25° C. through a pre-heater consisting of (2) sections each comprising 30" of ¼"OD stainless steel tubing wrapped with 72" of ½" wide electric heat tape ("Omegalux STH051-060") providing 470 watts of heating. The pre-heater is controlled by an Omron E5CK temperature controller with a separate over-temperature cut-off controller. Control thermocouple is placed in the liquid flow at the pre-heater outlet and the over-temperature thermocouple is placed between the heat tape and the tubing wall for safety at no-flow conditions. The dilution stream is pre-heated to 24° C. with a similar setup containing 3 sections. After the extruder, two devices are installed to allow control of back-pressure on the barrel while allowing polymer to exit when dispersion is not being made. The larger device, a ½" NuPro spring-loaded check valve with ½" NPT connections, is set to open at 350-700 psi depending on the spring tension adjustment. For liquid dispersion, a GO BP60 Back-Pressure Regulator (BPR) is installed and adjusted for no back-pressure initially, then set to maintain about 17.2 barg (250 psig) upstream pressure mid-run when dispersion is being made.

The dispersion product is collected directly after the back-pressure regulator, allowed to cool, filtered, and analyzed for particle size, pH, solids content, and viscosity. The aqueous dispersion produced has a solids content of 50.0 weight percent, a pH of 10.0, and a viscosity (RV-3 spindle, 22.6° C., 50 rpm) of 444 centipoise. The dispersed polymer phase is measured by a Coulter LS230 particle analyzer consisting of an average volume diameter particle size of 1.86 microns and a particle size dispersity of 18.1.

After forming the dispersions, a series of breathable laminates are prepared using POD 1 and POD 2 in the following manner. An appropriate amount of the POD is transferred to an A4 glass plate (which is well cleaned with water and methylethylketone) with a pipette to form a bubble-free continuous line across the substrate. The POD is then spread by rolling a fine screw steel roller caster for latex with a defined coating thickness yield (12, 20, or 36 microns) over the substrate to generate a continuous thin layer. The layer is then partly dried for one minute at room temperature. The partially dried layer is then over layered by a homo-poly(propylene) 20 g/m$^2$ spunbond nonwoven fabric fabricated out of $HSO_2$-25RG resin with a melt flow rate (230° C., 2.16 kg) of 25 g/10 min and density of 0.9 g/cm$^3$ (available from The Dow Chemical Company), over rolled by the same, but clean, fine screw steel latex caster as above to ensure proper contact and left for drying at (a) room temperature for 2 hours. After 2 hours, the sheets are moved to a Heraeus UT 5050 hot air oven at 80° C. for 10 minutes, or at 100° C. for 10 minutes. In the case of multilayer coatings, this whole procedure is repeated using in the previous step already pre-coated nonwoven laminate as a starting substrate.

Table 1 below summarizes the moisture vapor transmission rates (MVTR) and selected water column data on the samples described above.

TABLE 1

| POD Sample | Drying Temp (° C.) | Coating Thickness (μM) | MVTR (g/m$^2$/day) | Water Column (mm) (28 cm$^2$, 600 mm/min) |
|---|---|---|---|---|
| POD1 | 80 | 12 | 3930 | 110 |
| POD1 | 80 | 20 | 4011 | 100 |
| POD1 | 80 | 36 | 4042 | 60 |
| POD1 | 100 | 12 | 3885 | 260 |
| POD1 | 100 | 20 | 3794 | 240 |
| POD1 | 100 | 36 | 4030 | 220 |
| POD2 | Room | 20 | 5645 | 15 |
| POD2 | Room | 36 | 4956 | 100 |
| POD2 | 80 | 12 | 5288 | 130 |
| POD2 | 80 | 20 | 3891 | 160 |
| POD2 | 80 | 36 | 4643 | 160 |
| POD2 | 100 | 12 | 1886 | 180 |
| POD2 | 100 | 20 | 1763 | 140 |
| POD2 | 100 | 36 | 3411 | 170 |

As Table 1 shows, the laminates varied in performance under various conditions. POD2, because of the ammonium hydroxide neutralization, led to useful coating films at room temperature. The coatings formed with POD2 dried at room temperature exhibited the highest MVTR values among all of the samples. Drying temperature had a significant influence on the MVTR value of the POD2 coatings. FIG. 1 includes several SEM images illustrating the drying temperature impact on the coating structure. As seen in FIG. 1, as higher temperatures are employed, smoother surfaces result. From Table 1 and FIG. 1, an evident trend of dropping MVTR in POD2 coated articles is seen with increasing drying temperature. Without being bound to any scientific theory, the present inventors believe that this can be related to the smoothening of the film structure due to softening and melting effects, causing reordering of dispersion phases. Such a macroscopic smoothening is apparent from the micrographs in FIG. 1.

Nevertheless, in terms of MVTR values, such a treatment in POD1 did not lead (in contrast to POD2) to considerable changes or trends. Without being bound to any theory, the present inventors believe that this may because POD1 maintained effective porosity (permeability channels), while having a surface smoothing in macroscopic scale (micron resolution).

Another example is a repetitive coating of 20 g/m$^2$ spun bond nonwoven fabric fabricated out of H502-25RG homo-poly(propylene), with a melt flow rate (230° C., 2.16 kg) of 25 g/10 min and density of 0.9 g/cm$^3$ (available from The Dow Chemical Company), at speed of 450 m/min on a Papageno Lab Coater (curtain coater). The substrate has been coated with 10 g/m$^2$ of POD 8501 (preparation described in [paragraph [00156]) in one or two or three consecutive coating steps, with each of them followed by an on-line inter-drying step at 60° C. Then all the monolayer 10 g/m$^2$ (S1), double-layer 20 g/m$^2$ (S2), and triple layer 30 g/m$^2$ (S3) coated samples were treated off-line at 100° C. for 10 min in a Heraeus UT 5050 conventional oven. So prepared samples were then examined on a water column tester TEXTEST FX3000, equipped with 28 cm$^2$ head, at 60 Bar/min pressure increase setup, and exhibited water column performance summarized in Table 2.

TABLE 2

| Sample | Coating Gauge (g/m$^2$) | Water Column (mm) (28 cm$^2$, 600 mm/min) |
|---|---|---|
| S1 | 10 | 90 |
| S2 | 20 | 400 |
| S3 | 30 | 960 |

In another example, a series of breathable laminates are fabricated using the dispersions described above, using the following general procedure. A4 polypropylene nonwoven sheets are coated with the dispersions on a pilot curtain coater. The A4 sheets are stuck to a continuous carrier paper band and compactly coated with 6-14 g/m$^2$ coatings. A repetitive coating with inter-drying is possible as well. The reachable coating speed applied is up to about 1100 m/min.

In another example, a series of breathable laminates are fabricated using the dispersions described above, using the following general procedure. A4 polypropylene nonwoven sheets are coated with the dispersions on a pilot curtain coater. The A4 sheets are stuck to a continuous carrier paper band and compactly coated with 6-14 g/m$^2$ coatings. A repetitive coating with inter-drying is possible as well. The reachable coating speed applied is up to about 1100 m/min.

Advantageously, therefore, polyolefin dispersions as described herein may be useful in the manufacturing of breathable backsheets for the hygiene market, breathable clothing, breathable packaging, and breathable construction membranes. Specifically, in one or more embodiments, the techniques described above may provide cost savings, as the film/coating may be formed directly onto a final substrate (e.g., a nonwoven textile) allowing a manufacturer to skip a separate film extrusion, masterbatch addition, stretching, and lamination steps. Further, overall manufacturing may be simplified as the coating process may be integrated into a nonwoven manufacturing line, and be adapted to the same line speed as the nonwoven production (which can be 100 m/min to 1100 in/min). Still further, the breathability and MVTR can be finally controlled by various independent manufacturing parameters.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A method of forming an article comprising:

applying an aqueous dispersion to a porous substrate, wherein the aqueous dispersion comprises
a thermoplastic polymer,
a dispersing agent,
a neutralizing agent; and
water; and selecting a desired Moisture Vapor Transmission Rate (MVTR) of the article and removing at least a portion of the water employing a drying process comprising exposing the dispersion-coated porous substrate to one or more temperatures for times sufficient to achieve the selected MVTR;

wherein the article formed is breathable and has a MVTR of at least about 300 g/m$^2$ per 24 hours measured using ASTM Standard E96-80, upright cup method.

2. The method of claim 1, wherein the porous substrate has an average pore size of from about 50 micrometers to about 150 micrometers.

3. The method of claim 1, wherein the porous substrate is a nonwoven substrate, and the application of the aqueous dispersion to the nonwoven substrate is integrated into a manufacturing line of the nonwoven substrate at a line speed substantially equal to a line speed of production of the nonwoven.

4. The method of claim 3, wherein the applying the aqueous dispersion comprises curtain coating the non-woven substrate, and wherein the line speed of production of the nonwoven substrate ranges from 100 m/min to 1100 m/min.

5. The method of claim 1, wherein the thermoplastic polymer comprises a polyolefin.

6. The method of claim 1, wherein the dispersing agent comprises at least one ethylene/carboxylic acid copolymer.

7. The method of claim 6, wherein the ethylene/carboxylic acid copolymer is an ethylene/acrylic acid copolymer.

8. The method of claim 1, comprising a dispersed particulate having an average volume diameter size of 0.1 to about 5 micrometers.

9. The method of claim 1, wherein the neutralizing agent is ammonium hydroxide.

10. The method of claim 1, further comprising applying multiple layers of dispersions.

* * * * *